US011236513B2

(12) United States Patent
Simoens

(10) Patent No.: US 11,236,513 B2
(45) **Date of Patent: *Feb. 1, 2022**

(54) FLOOR BOARD WITH UNIVERSAL CONNECTION SYSTEM

(71) Applicant: BerryAlloc NV, Menen (BE)

(72) Inventor: Dieter Simoens, Kruishoutem (BE)

(73) Assignee: BerryAlloc NV, Menen (BE)

( * ) Notice: Subject to any disclaimer, the term of this patent is extended or adjusted under 35 U.S.C. 154(b) by 0 days.

This patent is subject to a terminal disclaimer.

(21) Appl. No.: 16/887,694

(22) Filed: May 29, 2020

(65) Prior Publication Data

US 2020/0291661 A1 Sep. 17, 2020

Related U.S. Application Data

(63) Continuation of application No. 16/020,350, filed on Jun. 27, 2018, now Pat. No. 10,689,860, which is a (Continued)

(30) Foreign Application Priority Data

Apr. 10, 2014 (EP) ..... 14164155

(51) Int. Cl.
*E04F 15/02* (2006.01)
*B21D 47/00* (2006.01)
*E04F 15/10* (2006.01)

(52) U.S. Cl.
CPC ..... *E04F 15/02038* (2013.01); *B21D 47/00* (2013.01); *E04F 15/107* (2013.01); (Continued)

(58) Field of Classification Search
CPC ..... E04F 15/02038; E04F 15/107; E04F 2201/0107; E04F 2201/042; E04F 2201/022; B21D 47/00
(Continued)

(56) References Cited

U.S. PATENT DOCUMENTS 4,917,532 A 4/1990 Haberhauer et al.
5,458,953 A 10/1995 Wang et al.
(Continued)

FOREIGN PATENT DOCUMENTS

CN 1909818 A 2/2007
DE 202015100159 U1 1/2015
(Continued)

OTHER PUBLICATIONS

Australian Examination Report for Australian Application 2015245532, dated Oct. 3, 2018, 4 pages.
(Continued)

*Primary Examiner* — Adriana Figueroa
(74) *Attorney, Agent, or Firm* — Hamre, Schumann, Mueller & Larson, P.C.

(57) ABSTRACT

A construction and methods of assembly and construction of boards, e.g. floor boards, are described. The boards have a peripheral connection arrangement for interconnecting of one board to another, a core layer e.g. made from a wood or fiber based material and a top layer applied to the core layer which may be decorative and may include or provide a wear layer. A further bottom layer may be applied to the underside of the core layer and is designed to be in contact with the floor or an underlay can be applied when in use. The connection arrangement includes interconnecting hooking tongues and corresponding catches which co-operate to produce both vertical and horizontal locking.

24 Claims, 21 Drawing Sheets

Related U.S. Application Data continuation of application No. 15/303,140, filed as application No. PCT/EP2015/057779 on Apr. 9, 2015, now Pat. No. 10,030,394.

(52) U.S. Cl.
CPC . *E04F 2201/0107* (2013.01); *E04F 2201/022* (2013.01); *E04F 2201/042* (2013.01)

(58) Field of Classification Search
USPC ..... 52/588.1
See application file for complete search history.

(56) References Cited

U.S. PATENT DOCUMENTS

| | | | | |
|---|---|---|---|---|
| 5,940,388 | A | 8/1999 | Nahar et al. | |
| 6,287,706 | B1 | 9/2001 | Simpson et al. | |
| 6,862,857 | B2 | 3/2005 | Tychsen | |
| 7,516,587 | B2 | 4/2009 | Barlow | |
| 7,543,417 | B2 * | 6/2009 | McIntosh | E04F 15/082 52/589.1 |
| 7,655,290 | B2 * | 2/2010 | Verrue | E04F 15/02 428/60 |
| 7,743,932 | B2 | 6/2010 | Lynch | |
| 8,191,328 | B1 * | 6/2012 | Liu | E04F 15/04 52/588.1 |
| 8,215,077 | B1 | 7/2012 | Dreyer | |
| 8,505,257 | B2 * | 8/2013 | Boo | B27G 13/14 52/582.1 |
| 8,726,603 | B2 * | 5/2014 | Huang | E04F 15/02038 52/591.1 |
| 9,314,936 | B2 * | 4/2016 | Pervan | E04C 2/40 |
| 9,499,979 | B2 * | 11/2016 | Huang | E04F 15/02038 |
| 9,670,682 | B2 | 6/2017 | Cappelle | |
| 9,822,533 | B2 * | 11/2017 | Huang | E04F 15/02038 |
| 2002/0056245 | A1 | 5/2002 | Thiers | |
| 2003/0009971 | A1 * | 1/2003 | Palmberg | E04F 15/04 52/578 |
| 2006/0179773 | A1 * | 8/2006 | Pervan | B44C 5/0469 52/592.1 |
| 2007/0113492 | A1 | 5/2007 | Dickey et al. | |
| 2008/0168730 | A1 | 7/2008 | Pervan et al. | |
| 2011/0173911 | A1 | 7/2011 | Propst | |
| 2012/0317911 | A1 * | 12/2012 | Huang | E04F 15/02 52/309.1 |
| 2013/0047536 | A1 | 2/2013 | Pervan | |
| 2013/0104486 | A1 | 5/2013 | Windmöller | |
| 2013/0283719 | A1 | 10/2013 | Dohring et al. | |
| 2015/0233127 | A1 | 8/2015 | Dohring | |

FOREIGN PATENT DOCUMENTS

| | | | |
|---|---|---|---|
| DE | 202016105668 | U1 | 11/2016 |
| EP | 0528194 | A1 | 2/1993 |
| EP | 0603310 | A1 | 6/1994 |
| EP | 1554954 | A1 | 7/2005 |
| EP | 2518237 | A1 | 10/2012 |
| EP | 2412892 | B1 | 6/2017 |
| KR | 1020030094235 | A | 12/2003 |
| KR | 1020110122694 | A | 11/2011 |
| WO | 9305227 | A2 | 3/1993 |
| WO | 2010087752 | A1 | 8/2010 |
| WO | 2011153916 | A1 | 12/2011 |
| WO | 2011153940 | A1 | 12/2011 |

OTHER PUBLICATIONS

Chinese Office Action for Chinese Application No. 201580019031.4, dated Jan. 31, 2019, with translation, 6 pages.
Chinese Office Action for Chinese Application No. 201580019031.4, dated Jul. 11, 2018, with translation, 12 pages.
European Communication for European Application No. 14 164 155.5, dated Sep. 26, 2014, 7 pages.
European Communication for European Application No. 15 718 808.7, dated Sep. 25, 2018, 6 pages.
Extended European Search Report for European Application No. 14 164 155.5, dated Sep. 26, 2014, 7 pages.
Extended European Search Report for European Application No. 18 212 772.0, dated Jun. 6, 2019, 10 pages.
International Search Report for International Application No. PCT/EP2015/057779, dated Aug. 27, 2015, 31 pages.
Entire patent prosecution history of U.S. Appl. No. 15/303,140, filed Oct. 10, 2016, entitled "Floor Board With Universal Connection System."
Entire patent prosecution history of U.S. Appl. No. 16/020,350, filed Jun. 27, 2018 entitled "Floor Board With Universal Connection System."
Korean Notice of Preliminary Rejection for Korean Application No. 10-2016-7031501, dated Jul. 26, 2021 with translation, 18 pages.
Canadian Examination Report for Canadian Application No. 2,944,827, dated Mar. 12, 2021, 4 pages.
European Communication pursuant to Article 94(3) for European Application No. 18212772.0, dated Mar. 25, 2021, 5 pages.

* cited by examiner

FLOOR BOARD WITH UNIVERSAL CONNECTION SYSTEM

CROSS REFERENCE TO RELATED APPLICATIONS

This application is a continuation application of U.S. patent application Ser. No. 16/020,350, filed Jun. 27, 2018, which is a continuation application of U.S. patent application Ser. No. 15/303,140, filed Oct. 10, 2016, which is a U.S. national phase application of PCT International Application No. PCT/EP2015/057779 filed Apr. 9, 2015, which claims priority to European Patent Application No. EP 14164155.5 filed Apr. 10, 2014, the contents of each application being incorporated by reference herein.

TECHNICAL FIELD

The present invention is related to boards, such as flooring boards, wall boards and ceiling boards and to an assembly of such boards and to a method of manufacturing of such boards.

BACKGROUND

Boards used in the construction of floors, walls and ceilings are composed of a wide variety of materials, and designed to be joined in wide variety of ways. Floor boards are often made of composite material including multiple layers of different materials. Floor boards are also joined to one another by a wide variety of structures and techniques, including standard tongue and groove connections and more complex and easy-to-use systems that employ adhesives and adhesive tape, snapping connections incorporated into board edges, angling board with interlocking edges, and overlapping edges. Many of the edges are specially designed to achieve objectives relating to strength, minimum visibility of the joint, prevention of ingress of water and dirt, durability, low cost of production and many others objectives.

In the case of flooring, there are two systems of vinyl floating floors that are currently available in the market. These are systems in which locking tongues and locking grooves are machined into the edges of the sheet comprising the flooring board. Problems with this system include the fact that in order to have sufficient room to form a machined vinyl locking tongue and locking groove on opposite edges of the board, the board is required to be quite thick, and vinyl itself is a relatively flexible and deformable material, not well-suited for creating a strong mechanical connection. Another system relies on adhesive strips applied to the underside of adjacent panels. However, these systems do not provide a mechanical connection between boards, they cannot be readily disassembled, and are difficult to install, because once a board is placed on the joining adhesive strip, it is difficult to re-locate.

Another flooring board having locking tongues and locking grooves machined into the edges of the sheet comprising the flooring board is described in WO 2010/087752 and shown in FIG. 16 of this application. As mentioned in WO 2010/087752 deep grooves will have a negative effect on the stability and strength of the panel edge. Problems with this system, in which a tongue and a groove must be formed on the same side edge of a board include the fact that in order to have sufficient room to form the locking tongue and the locking groove on the same edge of the board, the board is required to be quite thick, or if made thin, the tongue is not strong mechanically, especially when such boards are made from wood or fibrous material such as HDF or MDF, e.g. having a core layer or body of wood or fibrous material.

A further design is shown in FIG. 17 of this application which is taken from US 2012/317911. This document discloses a board comprising a frame, an upper material and a filler board; the upper material having an exposed upper face and an underside, the filler board being disposed within a space defined by the frame; the underside of the upper material being attached to an upper surface of the frame; the underside of the upper material being attached to an upper surface of the filler board; the frame having a plurality of latch tongues extending outwardly from the frame; the frame having at least one recess formed in its underside for engaging at least one latch tongue, the latch tongues and the at least one recess of each board being arranged to allow engagement of the tongues of a first board with the recess of a second adjacent board. The interlacing tongues between two boards provide both horizontal and vertical locking. Horizontal and vertical locking are terms well known in this art. This design requires an upper material, a frame, and a filler board, i.e. the use of multiple different materials.

US 2008/0168730 describes and shows in FIG. 9A (FIG. 18 in this application) how a herringbone pattern can be created using two boards (A, B) whereby one board is the mirror image of the other. This increases the complexity of the boards as well as the number of boards which increases inventory costs. Further to work out which boards are required to be purchased to form the pattern shown in FIG. 9A of US 2008/0168730 is not so easy.

SUMMARY OF INVENTION

It would be desirable to have a connection system for a polygonal board that combines attractive features such as one or more of universal design suitable for use and adaption to many different materials, each side of one board being connectable to any other side of another board, easy installation, low manufacturing cost, high quality finish, using recyclable materials, variety of sizes and shapes possible, universal manufacturing method, use of a small number of different materials, recyclability.

Embodiments of the invention are particularly suited for boards, such as flooring boards, wall boards and ceiling boards and which are intended to be mechanically joined. These boards can be based on a variety of materials of which plastic or polymeric or elastomeric materials such as PVC or foamed plastics, wood or fibrous material such as solid wood or HDF or MDF. The boards may have a core layer or body of materials such as plastic or polymeric or elastomeric material or wood or fibrous material. To provide a universal connection system it is preferred to avoid the use of manufacturing techniques that are suitable for only one design, e.g. injection moulding of frames, whereby for each size of frame another mould is required. The present invention makes use of machining which can be adapted to a variety of materials.

The present invention is particularly suited for floating floors, i.e. floors that can move in relation to the base on which they are laid. However, it should be emphasized that the invention can be used on all types of existing hard floors, such as homogeneous wooden floors, wooden floors with a lamellar core or plywood core, cores made of particle board, floors with a surface of veneer and a core of wood fiber, thin laminate floors, and the like. The invention can also be used in other types of floorboards which can be machined with cutting tools, such as subfloors of plywood or particle board. Even if it is not preferred, the floorboards can be fixed to the floor.

A purpose of embodiments of the present invention is the construction of a board with connection elements and the edges whereby the boards as made by machining a core layer, i.e. a core layer having one or more coextensive layers of material.

A purpose of the present invention is to provide an easy-to-lay composite floor board that is not wasteful of material, can be made with conventional manufacturing tools and hence requiring limited investment in the required equipment, and being manufacturable in several varieties having different functions. The connection design on the edges of the board can be applied or adapted to many different materials. Embodiments of the present invention allow sliding tessellation, i.e. sliding or snapping connection between any two sides of two different boards. A tessellation of a flat surface is the tiling of a plane using one or more geometric shapes, e.g. usually called tiles and called boards in this application, with no overlaps and no gaps. Embodiments of the present invention can provide adaption to different materials such as strengthening of tongues used for hooking or latching or provide means of strengthening of tongues used for latching to compensate for mechanical weakness induced by machining steps such as the machining of continuous or discrete grooves. Also different designs of tongue, e.g. width and shape can be used to vary the strength and ease of locking two boards together.

In particular the boards according to embodiments of the present invention are combinable to allow patterns to be formed which have connections on each edge of the board, which connections can be completed by sliding the boards together rather than by angling the boards although the latter is possible. Also, in accordance with embodiments of the present invention any one side can be connectable to any other side of an adjacent board, i.e. the same connection design can be used on each side. Such connections differ from the more conventional asymmetrical design where the connection on one side is complementary to the system on the side of another board with which it is joined.

Embodiments of the present invention do not need to use an asymmetrical tongue and groove arrangement for horizontal locking whereby a tongue protrudes from the side edge surface of one board and fits into a matching groove on the side edge surface of an adjacent board. Side edge grooves require an increase in the thickness of material that must be used for the board or reduce the strength of the board or of the tongues. For example in embodiments of the present invention the tongues of two adjacent boards form a construction like interlocking fingers which provide both the vertical and horizontal locking. The tongues of one board pass underneath an adjacent board.

Embodiments of the present invention are made from flat uniform boards and are not constructed from multiple components fixed or glued together. Embodiments of the present invention are frameless boards.

Embodiments of the present invention relate to a construction and a method of construction of such boards, e.g. floor boards, that have a peripheral connection arrangement for interconnecting of one board to another, a core layer e.g. made from a plastic or polymer or elastomer or wood or fibre based material or other suitable material.

The boards may be of multilayer construction. The core layer may comprise one or more layers including top layers. These top layers may be decorative and may include or provide a wear layer. The top or surface layer can be made, for example of a material selected from the group consisting of: a vinyl sheet, woven vinyl, carpet, high pressure laminate, direct pressure laminate, a ceramic tile, needle felt, wood, paper, printed or non-printed plastic material. In embodiments of the present invention the edges and edge faces and the abutment surfaces of the core layer are formed by machining. The core layer can be made of plastic, rubber, wood or a fibre based material such as solid wood, HDF or MDF for example.

The core layer may also comprise a bottom layer on the underside of the board and can be designed to be in contact with the floor or an underlay can be applied when in use. The bottom layer can co-operate with other layers of the core layer such as the top layer to provide a balanced board that remains flat and does not warp to an appreciable extent. Accordingly the raw material, the plank from which the finished board is machined can be a single layer or a multilayer construction whereby the layers of the plank are coextensive.

The present invention also includes an assembly of boards according to any of the embodiments of the present invention, the assembly being a tessellation.

The connection units on each or every edge of the board can be made by machining.

This machining comprises in embodiments of the present invention:

a) Machining a recess in the underside of the board and located a distance in-board of each edge of the board, either continuously or intermittently.

b) Machining the shape of a tongue into the upper surface of the board along the edges. The shape of the tongue may depend upon the material of the board c) Isolating individual tongues by machining away intermediate sections between the machined tongue shapes.

The repetition distance R of the tongues is given by (see FIG. 12D)

$$R=(2\cdot r\cdot V_{pi})/(n\cdot V_C)$$

Where r=distance edge of board to center of machining turret $V_{pi}$=velocity of the board $V_C$=velocity (in the same direction as movement of the board) of tool on the turret at the contact point with the board n=number of machining tools.

Each machining step may comprise a plurality of partial machining steps. Breaking each machining step into a plurality of shallow machining steps reduces the force applied to the board in each step.

The machining steps may be performed with the board static or moving. If the board is moving, step c) may be carried out by a machining aggregate that comprises a turret with rotating machining tools. The rotation of the turret can be synchronised with the line speed of movement of the board and can be continuous or non-continuous. The effective speed in the direction of the movement of the board as a result of the rotational speed of the turret may be the same or different from the speed of the board in that direction. The rotation of each machine tool about its own axis is preferably independent of the rotation of the turret itself so that the machining tools preferably have their own independent drive(s). This allows optimised rotation speed for the tool and material to be machined.

The repetition distance of the tongues isolated in step c) also depends on the distance between the board and the centre of the turret and on the respective velocities of the board and the machining tool. The choice of the number of machine tools on the turret will depend upon the repetition distance and the size of the machining tools that fit practically into a profiling line. The width of each tongue is the repetition distance minus gap (dimension "S") cut out by the machine tool. The dimension "S" depends on the dimension of the machine tool, the position of the machine tool on the turret branch, the distance to the board and the synchronisation between the turret and the board. The distance to the board, size and position of machine tool and synchronisation are preferably optimized in order to get as close as possible to a rectangular cut out of the tongue section of the board. The machine tools may cut at an angle with respect to the plane of the board.

The width of the tongues when isolated is smaller than the size of the space between adjacent tongues and is preferably chosen such that any edge of the board can be connected to any other edge of an adjacent board. When the tongues extend laterally from the lower edges of the core layer by a distance "t", and the tongues have a width T and are separated by spaces of length S and the shortest distance from an edge to the last tongue on one side is dimension "d", then in any embodiment of the present invention:

$$S>T$$

In some embodiments of the present invention the following inequality can apply (to allow various different possibilities for arranging the boards):

$$S>T+2t+d.$$

Preferably the space between two tongues is S and the distance of the edge of the last tongue on one side of the board is d whereby the edge of the tongue adjacent to the same corner but on another and adjacent side of the board is a distance S−d from that corner.

The machining processes can be carried out directly onto the board material without there being undercuts, i.e. recessed or overhanging portions but the present invention does not exclude the use of a multiple of machining tools which thereby allow a wide range of designs.

A board according to embodiments of the present invention can have a variety of attributes, each of which can be provided or some or all of which can be provided, e.g. any combination of these attributes can be provided in embodiments of the present invention. A selection of these separate but combinable attributes include:

a) Ease of laying.

b) The board has the shape of a tiling polygonal such as a square, a rectangle or oblong, a parallelogram, a hexagon or one eighth segment of a hexagon. The board may have two sets of two sides, each set having the same or a different length. A pattern of the flooring can be generated using sliding tessellation of the boards. This attribute allows laying patterns such as tessellations that support rotational symmetry or non-symmetry in the shape or pattern on each board as well as other transformations such that a wide variety of tiled patterns or tessellations are possible. A tessellation or tiling of a plane surface is a pattern of plane figures that fills the plane with no overlaps and no gaps. For example, copies of an arbitrary four sided figure such as a quadrilateral can form a tessellation with 2-fold rotational centres at the midpoints of all sides, and translational symmetry whose basis vectors are the diagonal of the quadrilateral or, equivalently, one of these and the sum or difference of the two. Tessellated flooring patterns such as square or quadrille, truncated square or truncated quadrille, deltoid trihexagonal or tetrille, truncated trihexagonal or truncated hexatetrille tilings are all included within the scope of the present invention.

c) A connection arrangement is provided on each of the sides, e.g. on each of the three, four, five or six sides of the core layer that can be used to join any side of one board to any side of another board.

d) The boards that are joined together can be identical or can be different but adapted in such a way that they are able to be tiled together. For example, a four sided floor board may be combined with similar boards or dissimilar boards to tile a plane surface such as a floor. The present invention includes combinations of floor boards which include at least one four sided floor board according to an embodiment of the present invention.

e) Embodiments of the floor boards according to the present invention also can be adapted to have good acoustic properties.

f) The connection arrangement should be makeable between adjacent boards by means of sliding and latching the boards together without the need to angle the boards. This allows a forming a flooring by sliding tessellation, for example using floor tiles.

g) The connection arrangement between the boards can also be optionally so constructed that the one board can be displaced (to a certain degree) in the direction of the mating edges of the two boards when the two boards are connected together. This allows adjustment of the relative positions of the two boards during laying, e.g. to align a pattern in the top decorative layer of adjacent boards.

h) In embodiments of the present invention the materials, shape and thicknesses of the all the layers of the board can be selected so that no part of the board telegraphs through to the top layer.

i) In embodiments of the present invention the material of the core layer and its thickness can be selected so that an unevenness of the floor does not telegraph through to the top layer.

j) The construction and method of manufacture of the floor boards of embodiments of the present invention include machining steps, e.g. to form the abutment surfaces where two boards are joined. The use of machining makes the connection system of the present invention universally applicable to different materials. Machining steps can weaken some materials and embodiments of the present invention provide inherently stronger parts such as hooking or latching tongues or means for strengthening certain parts such as hooking tongues. Embodiments of the present do not use methods that are limited to unique sizes such as moulding techniques which produced products limited to the dimensions of the mould. Embodiments of the present do not use methods that are limited to specific materials, e.g. injection moulding which requires plastic materials with a specific melt flow index MFI so that they can be moulded.

k) The connection arrangement of embodiments of the present invention can join the boards tightly and firmly without the use of adhesive, nails or screws or of angling the boards during installation.

l) Only relatively few materials, need to be used to make each board and these materials can be selected to be recyclable.

Embodiments of the present invention provide a polygonal board having a core layer with an underside, a topside and edges and edge faces, the core layer having a plurality of staggered hooking tongues extending outwardly from the edges of the core layer; the core layer of one board having at least two recesses formed in its underside on two sides for engaging with hooking tongues of another board, the hooking tongues and the at least two recesses of each board being arranged to allow sliding mating of the tongues of a first board with the recesses of a second adjacent board and with the recesses of a third adjacent board thereby forming an abutment surface in the joint between the first board and the second board and between the first and third boards, the at least two recesses being made by machining, the tongues and recesses of adjacent boards co-operating to provide both vertical and locking engagement of the two boards.

In particular the staggered tongues are preferably isolated from each other by machining.

A floor board according to embodiments of the present invention has an openable, closing or locking board connection system. The floor board can have an intermittent or continuous recess or groove or channel on the underside of one or more, preferably each edge of the floor board as well as spaced projecting tongues on each same edge as the recess(es). The tongues are formed in a staggered manner to be brought together with recesses in a closing or locking action in a form of interlocking fingers. Optionally the boards are dismountable by an angling motion. The tongues and recess of such a locking system can be produced by means of machining or shaping tools such as by milling. In particular the intermittent or continuous recess and the tongues can be made by machining. Hence the connection method is independent of the materials used. The tongues and the recesses of each board are preferably arranged to allow engagement of the tongues of a first board with the recess of a second adjacent board and the formation of an abutment surface in the joint between the first board and the second board. The connection system of embodiments is adapted to allow two adjacent sides of one board to be connected to sides of other boards by sliding and without the need for angling of any of the boards.

For sliding connection the tongues can have some flexibility or can be flexible in an elastic manner so that the tongues can deflect and ride under or over a locking element or bar on the recesses of an adjacent board. Such flexibility in the tongue can result in damage when the material used is weak, brittle or likely to delaminate. Some fibrous board materials exhibit this property especially after machining, e.g. machining of the intermittent or continuous recess or machining of protruding tongues.

In accordance with some embodiments of the present invention, the board design preferably includes a means for strengthening the root of each tongue. This is useful because the laying process of sliding latching requires some deflection of each tongue as it slides underneath an adjacent board and then latches into a recess to form the interlaced finger construction. This requires a flexing of the tongue and if this is mechanically too weak it can break or split. Hence each tongue must be long enough to latch into the corresponding recess, and strong enough but also flexible enough to latch without damage. A continuous recess placed inboard of the tongue root can weaken the tongue, e.g. if the recess is close to the tongue root the sheer strength can be reduced.

A variety of designs can be produced efficiently by machining. To provide a means for strengthening the root, in one embodiment the abutment surface has a sloping section that extends over a distance of at least 10% of the thickness of the board. The strengthening can be increased by the sloping section extending over at least 20%>, 30%>, 40%>, 50%> up to about 60% of the thickness. The sloping section extend horizontally at least 10% of the length of the tongue. To increase the sheer strength the sloping section can extend over at least 20%, 30%, 40%, 50% up to at least 60% of the length of the tongue. The sloping section can be at an angle of at least 10°, 20° or 40° plus or minus 10° or plus or minus 5° or up to 60°. The profile of the counterpart board must be adapted in order to allow a correct assembly. The advantage of this arrangement is the strengthening of the root of the tongues. But this will also make the tongue more rigid. If the material used for the board is rather flexible or rubber-like (such as an impact resistant plastic) this can be an advantage.

In another embodiment, the means for strengthening is provided by intermittent recesses such as discrete grooves or channels arranged so that there is no recess behind a tongue, i.e. in-board of the tongue there is no recess.

In another embodiment, the means for strengthening is provided by the material used for the tongue, e.g. the board is made of an elastic material such as a polymeric, elastomeric or plastic material such as PVC which can be foamed for example.

In another embodiment, the means for strengthening is provided by a coating on the underside of the tongues, e.g. a layer of plastic or resin such as fibre reinforced plastic or resin.

The machining techniques for use with the present invention such as milling, grinding, sawing or laser cutting or ablation can be adapted to many different materials. The machining techniques in accordance with embodiments of the present invention are adapted so that the reference dimension is from the top surface of the board. This has the advantage that the top surfaces of adjacent boards are at the same height.

The present invention provides in one aspect an easy-to-lay floor board, characterized in that it comprises a polygonal tiling, e.g. a three-, four-, or six-sided core layer and optionally a decoration layer fixed on or in the surface of the core layer, the core layer having or comprising latching or hooking tongues provided on the external edges of the core layer and catches, e.g. at least one recess or some recesses such as grooves or channels provided on the underside of edges of the core layer. Tongues and the at least one recess on each edge of each board are arranged to allow engagement of the tongues of a first board with the at least one recess of a second adjacent board (and vice versa) and preferably also with the at least one recess of a third adjacent board (and vice versa) with the formation of an abutment surface in the joint between the first board and the second board and between the first and third board. The at least one recess is preferably formed by machining. For a set of boards, preferably any side of any board can lock with any side of any other board.

The hooking tongue can have a rectangular, square, trapezoidal, or a radiused version thereof or semicircular, spoon or spatula shape when viewed from above, and is provided at intervals on the outer edges of the core layer. The shape is determined by the shape and the setup of the machining tools used as is described later. Each edge of a board is preferably prepared in a similar manner so that adjacent to, i.e. on at least one side of a tongue, a recess is provided, each recess forming a catch and having a shape corresponding to a lip or head of the square, rectangular, or a radiused version thereof or half-circular or spoon or spatula shaped hooking tongues and being provided on the underside of the outer edges of the core layer. The recesses are at least located beside or between the rectangular-shaped hooking tongues; the positions of the rectangular, square, or a radiused version thereof, or semi-circular, or spoon or spatula shaped hooking tongues on one outer edge of the core layer being arranged in a staggered manner, while the positions of the recesses on one outer edge of the core layer can be arranged in a staggered or continuous manner.

Such hooking tongues in accordance with embodiments of the present invention can be, provided at intervals on the outer edges of the core layer, each recess of at least two recesses corresponding in shape to the square- or rectangular-shaped tongues and being provided on the underside of the outer edges of the core layer beside the tongue. The distance from the inner side of the tongue head of the tongue to the edge of the core layer is equal to the distance from the inner side of the head of the recess to the edge of the core layer. These feature provides locking.

A tongue may have a tongue head with a distal and a proximal sides or edges. The distance from the proximal or inner side or edge of the tongue head of the hooking tongue to the edge of the core layer is preferably equal to the distance from an inner side of the recess to the edge of the core layer.

In particular the board can be an easy-to-lay floor board, comprising a four-sided core layer and a four-sided surface layer fixed and connected to the core layer, characterized in that the core layer comprises rectangular-shaped hooking tongues that are provided on the edges of the core layer; each edge of the core layer being uniformly provided with several rectangular-shaped hooking tongues; the underside of the edge of the core layer being provided with recesses beside the hooking tongues, corresponding to the hooking tongues; the positions of the hooking tongues on two edges of the core layer and the positions of the hooking tongues on two other edges of the core layer being arranged in a staggered manner, and the positions of the recesses on two edges of the core layer and the positions of the recesses on two other edges of the core layer being arranged in a staggered manner.

A number of different embodiments are described herein, and a number of different optional or preferred features are described. Unless otherwise stated, an optional or preferred individual feature or optional or preferred combination of features for any embodiment may be applied to any other embodiment described herein, unless otherwise stated or obviously incompatible.

Compared to existing techniques, embodiments of the present invention, especially those with inline machining, have at least one of the following advantages: a lower manufacture cost, lower equipment investment, a stable quality and is versatile in use.

Further details are disclosed in the appended claims each of which defines an embodiment of the present invention.

DEFINITIONS

Figure 1:
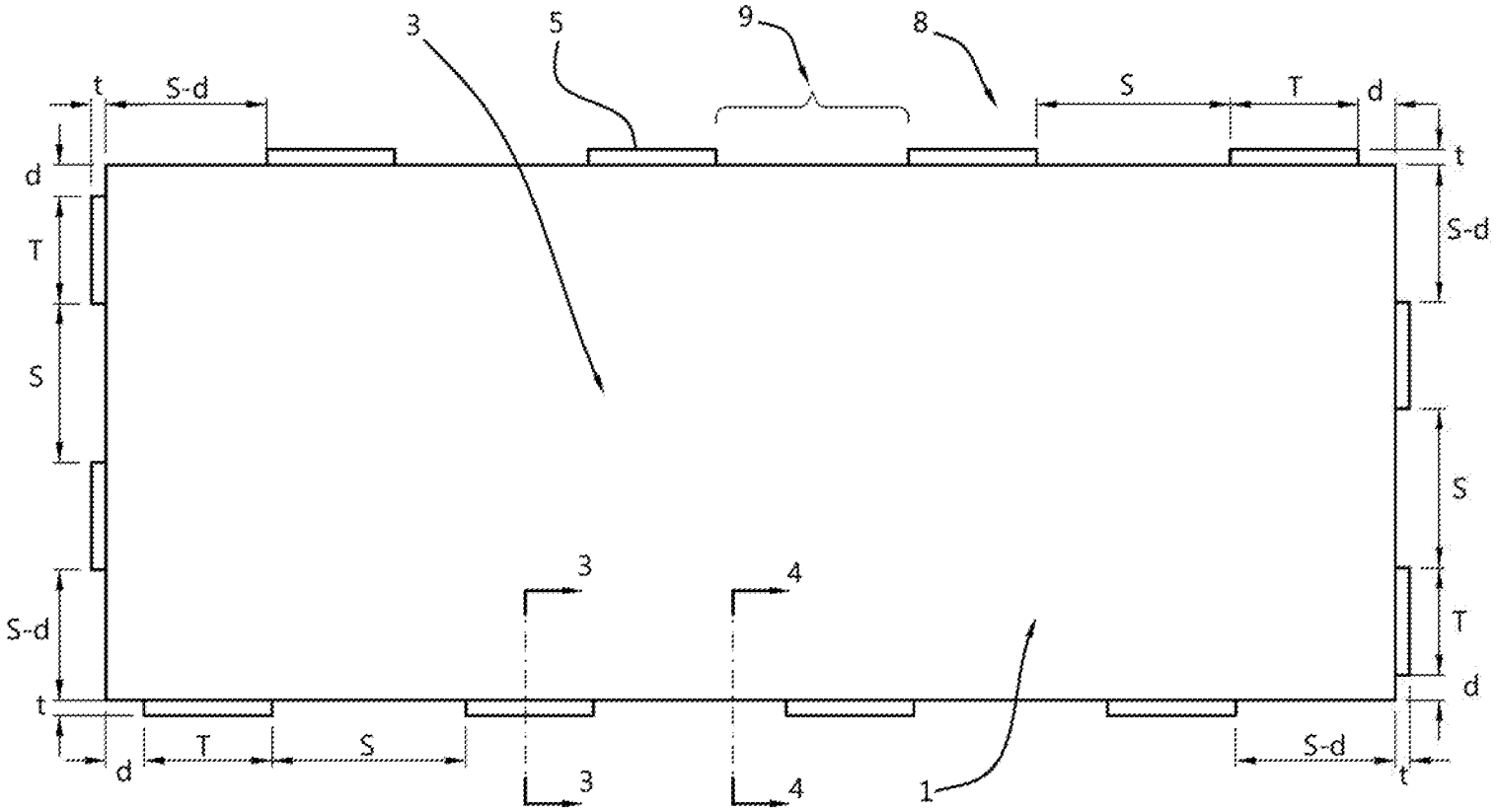
FIG. 1 is a schematic top plan view of one embodiment of the present invention.

"Tessellation" is the process of creating a two-dimensional plane using the repetition of a geometric shape with no overlaps and no gaps. The present invention provides floor boards that can be tessellated with any form of tessellation as described below. A regular tessellation is a highly symmetric tessellation made up of congruent regular polygons. Only three regular tessellations exist: those made up of equilateral triangles, squares or hexagons. A semi-regular tessellation uses a variety of regular polygons, of which there are eight. The arrangement of polygons at every vertex point is identical. An edge-to-edge tessellation is even less regular: the only requirement is that adjacent tiles only share full sides, i.e., no tile shares a partial side with any other tile. Other types of tessellations exist, depending on types of figures and types of pattern. There are regular versus irregular, periodic versus non-periodic, symmetric versus asymmetric, and fractal tessellations, as well as other classifications. For practical reasons it preferred if the floor boards as used with the present invention are tiles that can be tessellated with three, four, five or six sides or combinations of these.

"Sliding tessellation" in accordance with this application refers to the shape and construction of hooking tongues and recesses on each side of a tillable polygonal board such that a tessellated pattern can be produced by sliding latching of each board with respect to other boards of the pattern. Sliding tessellation is hard to be performed only by an angled connection with a rotational movement to lower one edge of one board vertically to engage with an edge of another board. For easy assembling one sliding motion is generally required and it is a particular advantage of embodiments of the present invention that sliding tessellation can be achieved easily and within the capabilities of an average installer. The present invention does not exclude an angling operation to join one side of a board to another. Also one edge of an already laid board may be lifted to allow the tongues of another board to be slipped underneath.

Directional terms are used herein to describe the relative positioning and configuration of various components on the board. The directions are given on the basis of a board resting on a floor, with the catches (e.g. recess having a locking edge, as described herein) on its underside, as described herein, and/or such that the decoration or surface board is located above the core layer. In use, however, the board may be used in any position, e.g. on a sloped floor, a wall or ceiling, as the skilled person would appreciate. The term "Tongue" refers to a protrusion from a side edge of a flat board. At the end of the tongue, i.e. the distal end from the board a protrusion is provided for latching into a recess on the underside of an adjacent board.

The term "recess" refers to an elongate cavity that cooperates with a tongue from an adjacent board to provide horizontal locking. Multiple interlocking tongues on both mating edges to two adjacent boards provide vertical locking.

Tongues co-operate with recesses to create a connection with horizontal and vertical locking while maintaining adjacent boards in the same plane. That is the top and bottom surfaces of adjacent boards are flush with each other.

The term "machining" relates to any of various processes in which a material is subject to a controllable material removal process. The term machining as used in this invention relates mainly to subtract! ve manufacturing.

Machining may include milling, sawing, shaping, planing, grinding or other material removal processes. These processes can involve the use of a sharp cutting tool to remove material to achieve a desired geometry. However the term machining also includes laser cutting or ablation.

Machining may be carried out by computer numerical control (CNC), in which computers are used to control the movement and operation of the machining tools.

DETAILED DESCRIPTION

The inventions set forth herein are described with reference to the above-described drawings and some specific examples or embodiments. The embodiments described are merely exemplary of the many variations that will be apparent to those skilled in the art.

A construction and methods of assembly and construction of boards, e.g. floor boards, are described which can be applied to a large number of different board designs. The boards have a peripheral connection arrangement for interconnecting of one board to another, a core layer e.g. made from plastic or polymeric material or a wood or fibre based material or other suitable material and a top layer integral with or applied to the core layer which may be decorative and may include or provide a wear layer. A further bottom layer may be integral with or applied to the underside of the core layer and is designed to be in contact with the floor or an underlay can be applied when in use. The bottom layer may also act as a balancing layer, i.e. to keep boards flat and preventing bowing. The connection arrangement includes interconnecting hooking tongues and a corresponding recess or recesses. The tongues can be reinforced with a substantial root section to provide improved resistance to bending forces. This stronger root section can be provided by the use of discrete recesses whereby the recesses are only adjacent to a tongue and not at the tongue position.

Embodiments described herein comprise a core layer. Optionally, a core layer includes, but is not limited to, a layer that acts to provide structural stability to the floor board. The core layer may be a multilayer but is preferably an integral, i.e. it is made of one piece of material. The material from the core layer can be made of fibres or other discrete components that are formed together into a single piece. The core layer may act to support a further component or components of the board thereon, for example the decoration or surface layer described herein and/or the core layer may act to provide sufficient lateral strength and stability, i.e. in a plane of the board, as required to ensure the board cannot be compressed or otherwise distorted to any great extent, if at all, in normal use, e.g. when engaging with other boards and/or once in place as a floor board, if used for this purpose. The layer disposed on the core layer may be termed a decoration layer or a surface layer herein. Optionally, a decoration layer includes, but is not limited to, a layer displaying a decoration or a layer on which a decoration could be displayed.

Optionally, the decoration shown may, for example, be selected from lines, colours, contours, shape, texture, materials from which the decoration layer is made, and any ornamentation present thereon. For example, the colour may be a colour of the material that is used to form the decoration layer, or any visible part thereof, or a colour printed on the board. Optionally, a surface layer includes, but is not limited to, a layer having an exposed upper surface.

Optionally the decoration layer, may, itself, be a flexible body, i.e. not necessarily rigid when separated from or attached to the core layer.

In addition a bottom or balancing layer(s) may be applied. This may be a paper layer and is used to strengthen the board and to prevent warping.

In all of the embodiments of the present invention hooking tongues can slide beneath an adjacent board and the tip of the tongue locates in a recess in the adjacent board. Each edge of the board has both a recess or recesses and spaced apart tongues with the recess or recesses arranged between the tongues so that tongues of one board locate in a recess or recesses of the adjacent board and vice versa. All of the embodiments of the present invention allow sliding tessellation, i.e. allow joining of one board to two other boards in any orientation in a tiled pattern with no overlap or spaces.

As described herein, embodiments comprise interlocking or hooking tongues and recesses. The hooking tongues and recesses on a board preferably cooperate such that a hooking tongue on one board can engage with, e.g. latch into, a recess on another board of the same or different configuration to prevent boards being separated laterally, i.e. in the same plane as the boards. The tongues and recesses are preferably adapted so that they latch together by a flat sliding motion rather than requiring the need to angle one of the boards. Also the hooking tongues and their matching recesses are preferably designed so that two adjacent sides of the one board are slidably connectable to two other boards. The hooking tongues on a board are optionally generally planar hooking tongues, generally provided with one or more features, e.g. vertical protrusions or projections, that allow them to engage with the recesses. Such a hooking tongue may be a tongue that has two substantially flat opposing surfaces and may be of a regular shape when viewed from above the board having the tongue; such regular shape may selected from rectangular or square, for example.

In any embodiment, the core layer can comprise a wood material, e.g., of solid wood or a wood fibre material from a very wide range of developments, for example, a particle board, however preferably an MDF board or an HDF board. The core layer is that portion of the floor board that makes the prominent contribution towards the total thickness of the floor board and that ensures the torsional stiffness and/or flexural strength of the floor board. For this reason, the core layer is that layer of a floor board with the greatest thickness.

In any embodiment, the core layer can comprise a polymeric, elastomeric or plastic material such as PVC.

In all of the figures "P" refers to the top plane of the board which is the reference plane for measurements and this plane "P" is the reference plane used to define how deeply any machining tool goes into the material of the board.

Embodiments

Figure 2:
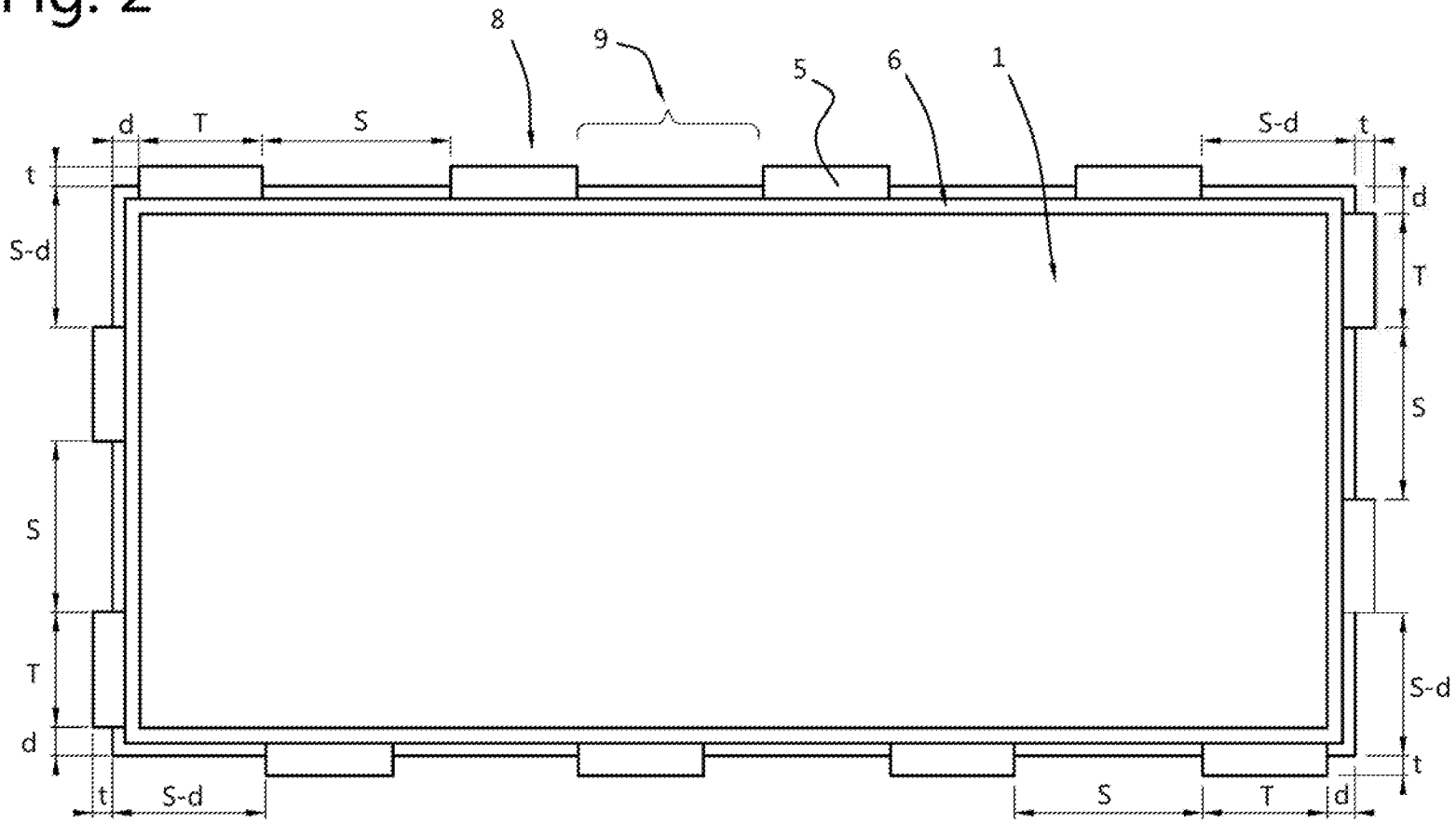
FIG. 2 is a schematic bottom plan view of the embodiment shown in FIG. 1.

FIG. 1 is a top plan view, somewhat schematic in nature, showing the general construction of a floor board 8 in accordance with any of the embodiments of the present invention which can also be used for other purposes such as a wall board or ceiling board, including a core layer 1, the top surface of which is affixed (in this instance by an adhesive) to the underside of a decoration or surface layer 3. The board is four-sided and in this case oblong. Another number of sides and other shapes are included within the scope of the invention such as three-, four-, five- or six-sided shapes that can be tessellated either with themselves or with other shapes. FIG. 2 is a bottom plan view of the board 8 shown in FIG. 1.

The core layer 1 in FIGS. 1 and 2 includes a single piece or sheet of wood- or fibre-based material such as HDF or MDF or can be a composite, or can be a multilayer product e.g. including plastic, elastomeric or polymeric or plastic material, e.g. a foamed material. The core layer 1 also has recesses 6, the tongues 5 and recesses 6 in embodiments preferably being integrally formed in the core layer 1, e.g. by a shaping process such as milling. In FIG. 2 the recess 6 is shown continuous along each edge. The present invention also includes the recesses 6 being discrete and running parallel to the space 9 so that there is no recess 6 inboard of a tongue 5 or only part of a recess 6 is inboard of a tongue 5. The tongues 5 each have a width T and the tongues 5 are separated from at least one adjacent tongue 5 by spaces 9 having a length S. In the example of FIGS. 1 and 2 the ratio of S to T is greater than 1, e.g. greater than 1.5:1, e.g. up to 2:1 or greater. The spaces 9 have dimension S greater than the width T, so that the tongue 5 of a first board may fit easily between the tongues of a second board to which it is intended to be joined. The position of the tongues on one side can be staggered or offset with respect to the positions of the tongues on an opposing or opposite side. For example when two boards are joined together their ends can be coterminous, or offset with respect to each other. A tongue 5 on one side can be aligned with a space 9 on an adjacent board. This staggered placement of tongues 5 and spaces 9 is characteristic not only of both the long and short sides of the oblong board 8 but also boards having other shapes or numbers of sides. Hence, two boards can be locked together using the tongues like interlaced fingers to provide vertical and horizontal locking while allowing each board to be exactly aligned with the next board or offset as the case may be.

In FIGS. 1 and 2, tongues 5 extend laterally from the lower edges of the core layer 1 by a distance "t", and the tongues 5 have a width T and are separated by spaces 9 of length S. The distance from the edge of the last tongue on one side is shown as dimension "d". In any embodiment of the present invention:

$$S>T$$

In embodiments of the present invention the following inequality can apply (to provide various different mutual arrangements of the boards):

$$S>T+2t+d.$$

This is generally the minimum size of S in order to be capable of assembling one side of one board to all other sides of another board in any pattern without using "angling" laying techniques.

The spacing between tongues is the dimension S. At the corners of the board the distance of the end of one tongue to the corner is "d". In this case the distance from the corner to the next tongue on the following edge is S−d. Thus the distance between any two tongues along the edges is "S" independent of whether the tongues are on the long side, the short side or whether the space S is spread over two edges.

The total thickness of the board 8 can, as is customary for floor panels, be roughly 4 to 11 mm, but can also be thicker, for example, 11 to 15 mm, or thinner 2.5 to 4 mm. The thickness of the core layer can essentially correspond to the thickness of the board, particularly in the case that no additional layers such as noise-protection material are used and if the surface layer is only fractions of a millimeter thick. Preferably the thickness of the core layer is 2 to 10 mm, for example 3 to 8 mm. Preferably, such floor boards have a width between 10 cm and 100 cm, a length between 0.3 m and 2.5 m. The size is generally limited by practical handling limitations otherwise there is no particular limit on size.

Figure 3A:
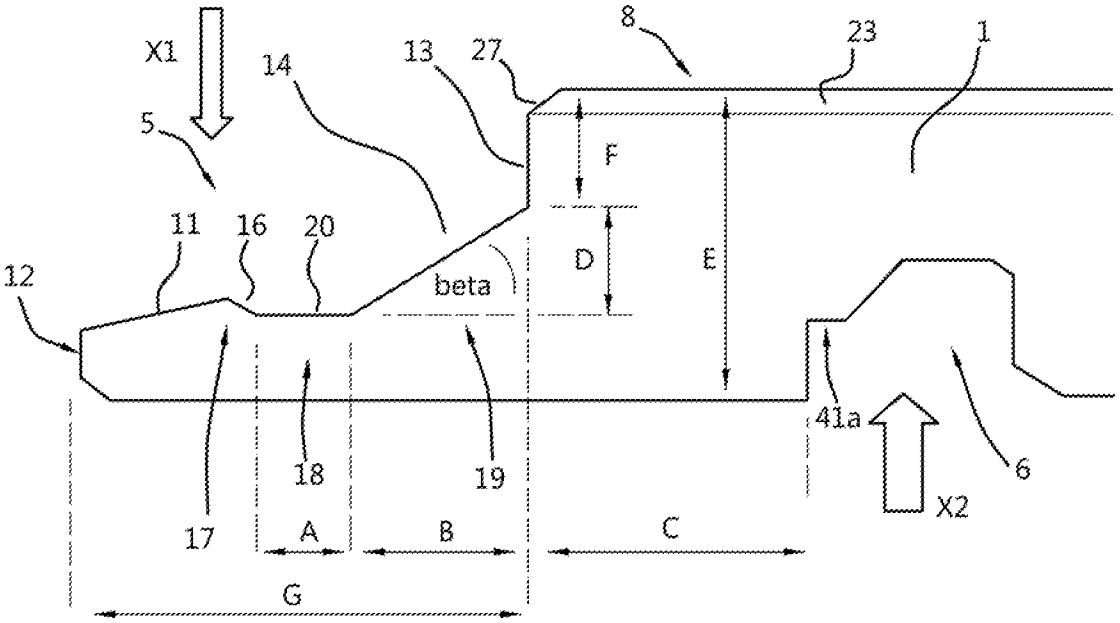
FIGS. 3A and 3B are cross-sectional views taken along the line 3-3 of FIG. 1.
Figure 3B:
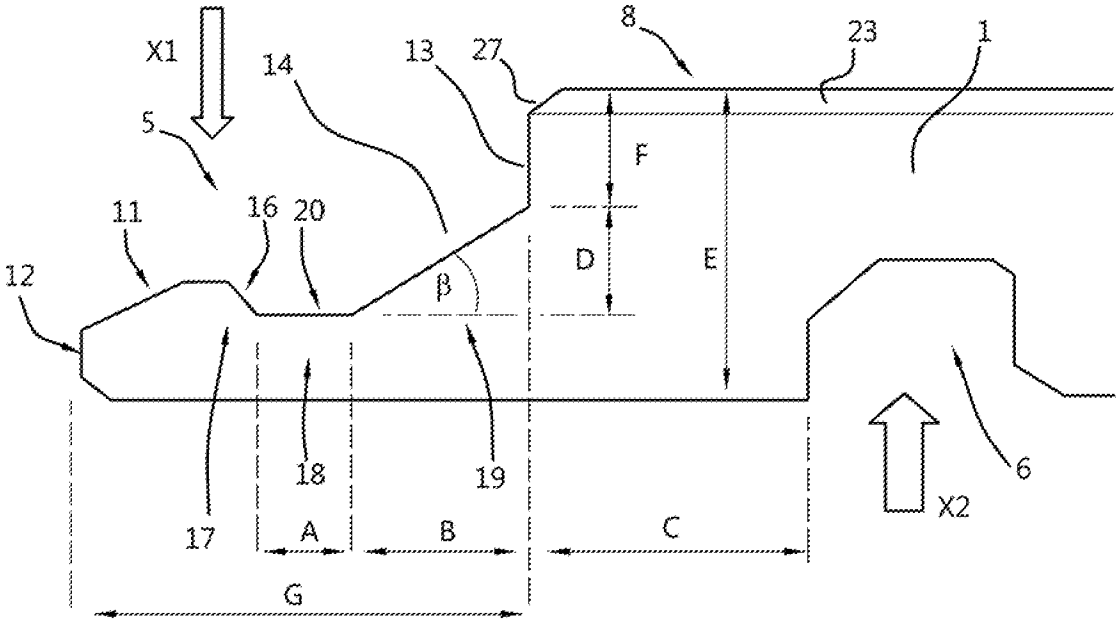
Figure 4:
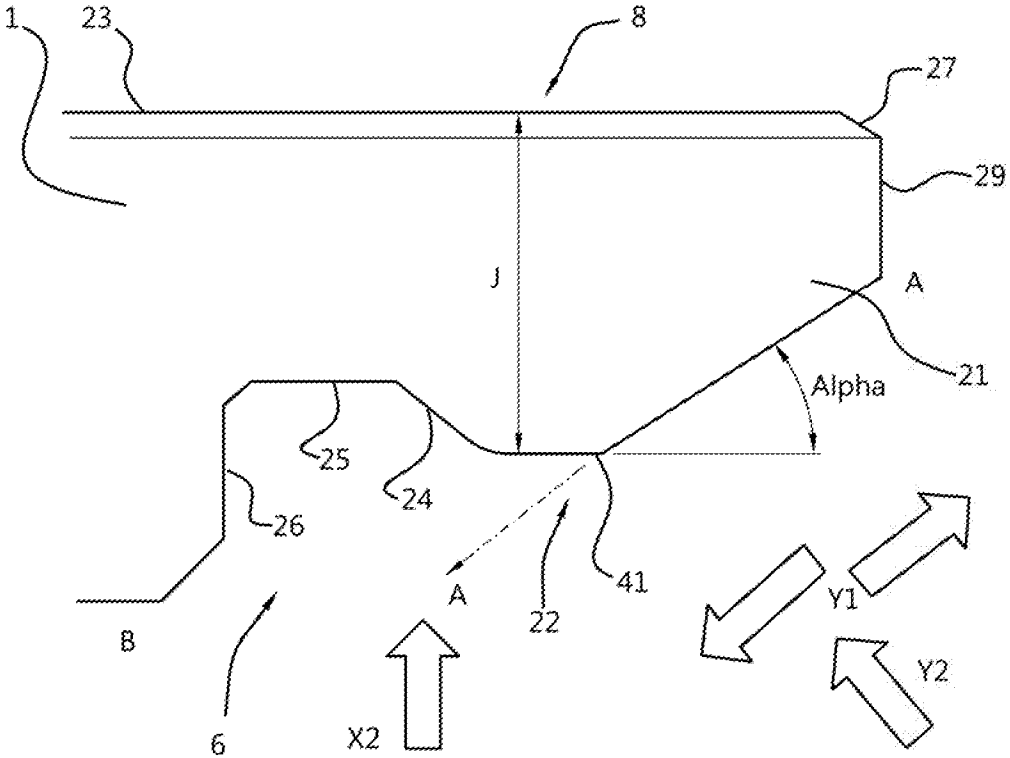
FIG. 4 is a cross-sectional view taken along the line 4-4 of FIG. 1.
Figure 5:
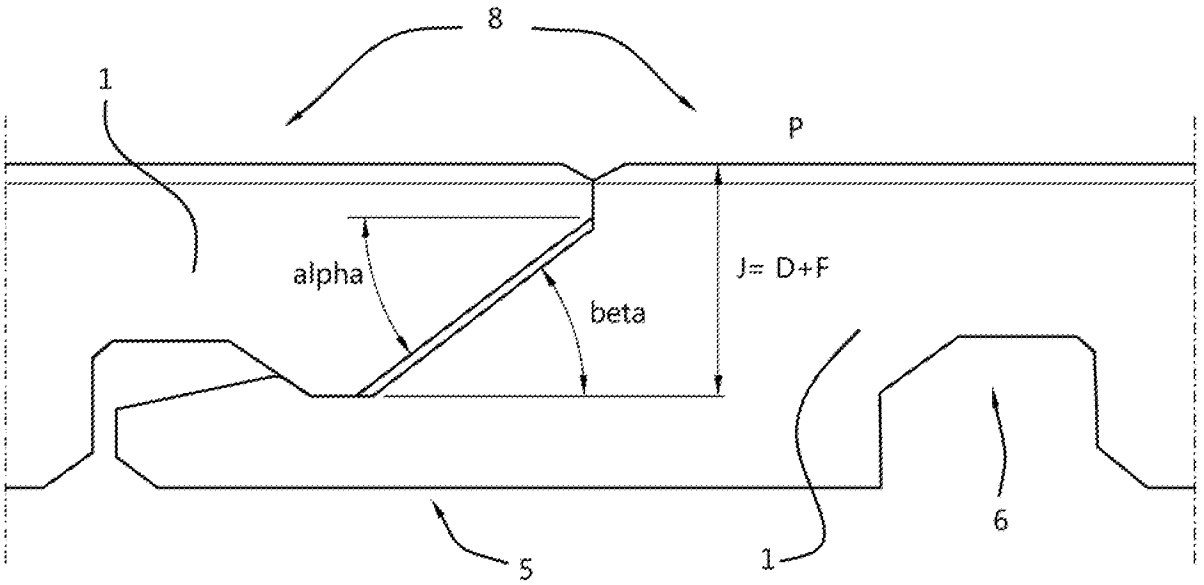
FIG. 5 is a cross-sectional view of two boards joined together.

FIGS. 3A, 3B, 4 and 5 are enlarged cross-sectional views of the edges of the board of an embodiment of the board as shown in FIGS. 1 and 2. This embodiment has a tongue form which is reinforced at its root. This increases stiffness and can be used with elastic, e.g. rubbery materials like impact resistant plastics. It can also be used with materials with low sheer strength. FIGS. 3A and 3B are views of the section along line 3-3 of FIG. 1, and show a cross-section of a tongue 5. The tongue shape of FIGS. 3A and 3B are very similar. An intermediate section 18 of the tongue 5 extends from a strengthening and stress-relieving base 19 towards the distal end of the hooking tongue 5. An upwardly extending projection 17 is disposed on the distal side of the tongue 5. The projection 17 has a bevelled nose 11 that faces generally outwardly and upwardly away from the board 8. The bevelled nose 11 slopes downwardly to the tip of the nose. The tongue 5 has a generally vertical tip surface 12 forming the side face of the bevelled nose 11. A further bevelled or rounded surface may be provided at the bottom of the surface 12 to form a tapered nose to the tongue 5. The projection 17 includes yet a further locking bevelled surface 16 which forms a generally inclined locking surface. Surface 16 faces upwardly and inwardly and slopes downwardly in a direction towards (more proximate to) the core layer 1 to a generally flat bearing surface 20 on top of the intermediate section 18. The upwardly facing surface 11 can meet the downwardly sloping surface 16 at an apex or a small flat (not shown in FIG. 3A but in FIG. 3B). The flat bearing surface 20 may be horizontal (as shown) or inclined up or down e.g. plus or minus 5°. A larger bevelled surface 14 extends upwards from the flat bearing surface 20 towards the core layer 1 to join and merge with the main core layer 1. The inclination of the surface 14 is shown as the angle "beta". This may be an angle in the range 10 to 60° to the horizontal for example. Both the horizontal extent of the sloping section (dimension B) and the vertical extent (dimension D) can be set as desired. Although shown as straight, the surface 14 can be curved. The inclined surface 14 defines with the underside of the core layer 1 a strengthening and stress-relieving base 19. The thicker section of this base adjacent to the main part of the core layer 1 provides increased resistance and strength to bending moments at the root, i.e. it increases the strength of the root of the cantilever formed by the tongue 5. An equivalent surface can or is provided in the catch (surface 21 in FIG. 4 at an angle alpha, generally alpha and beta have the same value). The combination of the two has the effect that the joint plane has a significant length that is defined by the surfaces 14, 21 and which is inclined at an angle of 10 to 60° as best shown in FIG. 5. In two specific embodiments the inclination is 40 plus or minus 10°, e.g. 42° and 35°. This inclined abutment region extends over a thickness of the board of at least 10% or optionally at least 20%>, 30%>, 40%>, 50%> up to maximum of 60%>. The extent over the thickness is shown in FIGS. 3A/3B as dimension D. The thickness of the board 8 is shown as dimension E. The percentage that the sloping section 14 extends over the thickness is therefore the ratio D/E×100%. The length of the sloping section in the horizontal direction can be at least 10% or optionally at least 20%, 30%, 40%, 50% up to maximum of 60% of the length of the tongue. The higher the percentages of these dimensions, the stronger the tongue but also the stiffer it is.

At the root of the tongue 5, where the inclined surface 14 merges into the core layer 1, a vertical surface 13 is provided which forms an upper abutment surface when two boards are joined together. This vertical surface 13 may be wholly in the core layer or may be wholly or partly in a decoration, tread or top surface layer 23. On the upper edge of the abutment a bevel 27 may be provided. This bevel 27 may be wholly in the core layer or may be wholly or partly in a decoration, tread or top surface layer 23.

The tongue 5 upper shape is preferably obtained by machining along the complete length of the edge of the board 8 as indicated by the arrow XI. XI indicates the movement of a suitable tool such as a milling tool that is used to form the upper surface shape of the tongue 5 by machining as is described later with reference to FIG. 15. The formation of the upper shape may include a sequence of machining steps, each removing only a partial amount of material. Each step may be carried out by a different tool, each tool having its own shape and depth of cut. The use of sequential machining steps lowers the force on the board made by any one step.

The tongues are isolated from each other by the distance S shown in FIG. 1 by a machining process as described with respect to FIG. 12A-12D, 13A-13C or 14A-14D and indicated by the arrow YI or Y2 in FIG. 4.

A recess 6 in the form of a channel is disposed inwardly of the base 19 of the tongue 5. Due to the fact that this recess 6 is on the underside of the board (rather than on a side abutment surface), the hooking tongue 5 has to extend underneath an adjacent board. The length of tongue can result in a weakness to bending forces during installation or transport. Thus the inclined surface 14 provides a significant strengthening factor for the longer tongue 5 especially when the core layer is made of a wood-based or fibre-based material such as MDF or HDF. The recess 6 is visible in FIG. 3 because the recess 6 is machined long the complete length of the edge of the board 8 in this embodiment as indicated by the process defined for arrow X2. X2 indicates the movement of a suitable tool such as a milling tool that forms the recess 6 by machining as is described later with reference to FIG. 15. The recess 6 may have various shapes, examples are shown in FIGS. 3A, 3B, 14A and 14C. In particular the recess 6 may have a step 41*a* (shown in FIGS. 3A and 13A but not in FIG. 3B) which after machining will form the flat 41 shown in FIG. 4.

FIG. 4 is a cross-section through the edge of a board 8 along line 4-4 of FIG. 1 at a location between the tongues 5, i.e., at the location of a space 9 and shows the recess 6. The shape of the edge face as shown in FIG. 4 is preferably such that it will form a coplanar joint with a tongue of FIG. 3 so that the upper surfaces of joined adjacent boards are flush with each other. FIG. 4 shows a locking edge 22 having a bevelled surface 21 that faces downwardly and outwardly from the core layer 1. The angle to the horizontal of surface 21 is alpha. The angle alpha may be in the range 10 to 60° in this embodiment. Other angles are possible such as 20, 30, 40, 50°. The locking edge 22 has a further bevelled locking surface 24 which forms one boundary of the recess 6. The locking surface 24 is adapted to engage the locking surface 16 on the projection 17 of a tongue 5, when adjacent boards are joined. The locking edge 22 also has a horizontal surface 41 at its underside which joins the bevelled surfaces 21 and 24 together. The surface 41 nestles in the flat surface 20 of the tongue 5 when two boards are joined. The distance "J" from the top surface of the board to the flat surface 41 determines how one board lies with respect to an adjacent board in combination with the dimension E-F-D of FIGS. 3A/3B. The dimension E-F-D+J should be equal to the thickness E of the board. The horizontal surface 41 is machined so as to reduce the thickness of the board at this point to allow the tongue 5 to pass underneath the core layer 1 and lock when two or more boards are joined by sliding tessellation. The E-F-D+J being equal to the thickness E means that the boards will lie in the same plane with the top surface flush. A surface like surface 41 can be generated by a longitudinal machining of a recess 6 (as described with reference to FIG. 15) having the shape 41*a* as shown on the right side of FIG. 13A followed by a further machining step to isolate the tongues as described with reference to FIG. 12A to 12D, 13A-13C or 14A or 14C, The extension of the line A-A along surface 21 preferably does not interfere with the corner B or only such as to form a bevel when the machining method of FIG. 12A, 13C, 14A or 14C is used.

The inclination of the surface 21 may be 10 to 60°, e.g. 20°, 30°, 40°, 50°, 60° plus or minus 10° or plus or minus 5° to the horizontal. Although shown as straight, the surface 21 can be curved. It should be noted that surfaces 14 and 21 should be preferably at the same angle to the horizontal, and the orientation of those abutment surfaces may be varied to make it easier or more difficult to disengage joined panels or boards. In particular when two boards are assembled it is preferred if there is a slight gap between the surfaces 14 and 21 of the order of 0.05 or 0.1 to 0.5 mm or more so that these surfaces do not meet before the surface 16 has locked behind the surface 24.

At the top end of inclined surface 21 a vertical surface 29 is provided which forms an upper abutment surface when two boards are joined together. This vertical surface 29 may be wholly in the core layer or may be wholly or partly in a decoration, tread or top surface layer 23. On the upper edge of the abutment a bevel 27 may be provided. This bevel 27 may be wholly in the core layer or may be wholly or partly in a decoration, tread or top surface layer 23.

Optionally the recess 6 has a top surface (or ceiling) 25 adapted to accommodate the nose of the projection 17 on the tip of a tongue during the locking process when adjacent boards are joined together. The top surface 25 may be flat (as shown) or curved and can be horizontal or inclined. The recess 6 may also have a generally vertical back wall 26. The bottom of the back wall 26 may also be bevelled or rounded. The surface 24 should preferably match the surface 16 of FIGS. 3A and 3B to provide locking.

In FIGS. 3A, 3B and 4, dimensions A, B and C correspond to the length (A) of the flat bearing surface 20 of the intermediate section 18, the distance (B) from the start of the inclined surface 14 to its end as it merges with the core layer 1 and the distance (C) from this merging position to the start of the recess 6, respectively.

Dimension A+B is approximately the transverse cross-sectional length of the locking edge 22 that is received by the space defined by top surfaces of the intermediate section 18. The relationship between A and B may be varied along with other factors such as the frictional properties of the materials used, and the extent to which flexible or pliable materials are used, both in the manufacture of the core layer and in the manufacture of the decoration or surface layer 3. Depending on the importance of having a gap-free joint and possibly on the importance of having panels or boards that are able to be displaced and/or disassembled dimension A may be greater than, equal to, or less than B. The ratios of A:B:C can be for example, 1:2:3 or 1:3:4 or in general 1:X:X+1 where X can lie between 1.5 and 5.

The dimension B+C is an indicator for the sheer strength between the tongue 5 and the recess 6. Strengthening the root by a sloping section is limited by the thickness E of the core layer. Hence these dimensions determine how strong the root of the projecting hooking tongue is. For maximum strength the root has a thickness close to the thickness of core layer which then tapers gracefully to the tip of the tongue. This increases stiffness however.

In embodiments of the present invention, the ratio of the dimension F to E can be in the range 0.3 to 0.7, e.g. 0.4 to 0.6. The ratio of the dimension G to the dimension E can be 0.6 to 1.8 e.g. 0.8 to 1.4.

FIG. 5 is a cross-sectional view of two boards in accordance with FIGS. 3A, 3B and 4 in a joined configuration. The boards described with reference to FIGS. 3A to 5 may include a decoration or surface layer 23. For example a luxury vinyl sheet with an embossed upper decorative layer can be affixed by an adhesive layer 28 (not shown) to the top surface of the core layer 1. The decorative or surface layer 23 may be chamfered or bevelled at the position of the join between two boards (the bevel edge has the reference number 27 in FIG. 3A, 3B). The effect of the bevel 27 is to create a V-groove at the junction of two boards when they are installed.

The adhesive layer 28 should be elastic and should preferably be more elastic than the material of the core layer. A number of adhesives that are suitable for connecting surfaces made of wood or wood materials are suitable for use as the adhesive layer 28. These are, for example, hot-melt adhesives such as are used, for example, for gluing veneers, dispersion adhesives or solvent adhesives (e.g. casein glue), contact adhesives such as are used, for example, for particle boards or hardboards, glues such as, for example, joiner's glue such as is conventionally used for wooden joints, or reactive adhesives, e.g., multi-component adhesives based on epoxy resin, or UF (urea-formaldehyde) resin, MF (melamine formaldehyde) resin, PF (phenol formaldehyde) resin or RF (resorcinol formaldehyde) resin. The adhesive layer 28 can, however, also be applied more thickly, as would be necessary for purely connecting purposes. In addition the adhesive 28 can be used for improving noise propagation.

The core layer can be made of a plastic or polymer material such as vinyl. The decoration or surface board 23 can be a decorative vinyl flooring sheet. Where there are multiple layers these may be laminated or fixed to each other by any suitable means such as glue, pressure, extrusion, casting etc. Such a vinyl flooring sheet preferably has an embossed upper layer made of a vinyl chloride-containing polymer or a PVC-free floor covering vinyl polymer material and eventually equipped with a protective coat of a polymer adhering to said vinyl chloride-containing polymer or PVC-free floor covering vinyl polymer material.

Examples of suitable vinyl chloride-containing polymers for the vinyl flooring sheet of the decoration or surface layer 23 include any such vinyl polymer having the desirable combination of properties like flexibility, resistance to walking, ease of cleaning and the like. These include homopolymers and copolymers of vinyl chloride.

Examples of suitable PVC-free floor covering vinyl polymer materials for the vinyl flooring sheet of the decoration or surface layer 23 include, but are not limited to, polyethylene, polypropylene, ethylene-vinyl acetate copolymers of low density or very low density having the desirable combination of properties like flexibility, resistance to walking, ease of cleaning and the like. These include ethylene-vinyl acetate copolymers with a melt index between 0.3 and 8.0 g/10 min (190° C./2.16 according to DIN 53 73) as described for instance in EP-0 528 194-B. Other floor covering vinyl polymer materials are described in U.S. Pat. Nos. 6,287,706, 5,458,953, EP 0603310-B and EP 0528194-B, the content of which is hereby incorporated by reference.

The protective coat of a polymer adhesive to said vinyl chloride-containing polymer or PVC-free floor covering vinyl polymer material may be made of any coating material having the desirable combination of properties like glass transition temperature, elongation at break, and tensile strength, such as, but not limited to, polyurethane or polyacrylate lacquers.

The vinyl chloride-containing polymer or PVC-free floor covering vinyl polymer material may further comprise one or more organic or inorganic additives known in the art, and/or one or more intermediate support or carrying layers made of PVC or PVC-free polymer materials, including reinforcement in the form of glass fibers, or other non-woven systems, or by using cross directional layers of PVC or PVC-free polymer materials for stabilisation, and a bottom surface layer made of PVC or PVC-free polymer materials.

The top surface layer 23 may extend beyond the perimeter of the core layer 1, and can be varied, such that a joint made with boards can be made more or less tight, depending on particular design objectives. Other factors are such as whether the boards are made such that the decoration or surface board is laterally larger than the core layer 1, whether the core layer is made from a material that has flexibility, and whether it is required that the boards be displaceable along their joined edges.

Figure 6A:
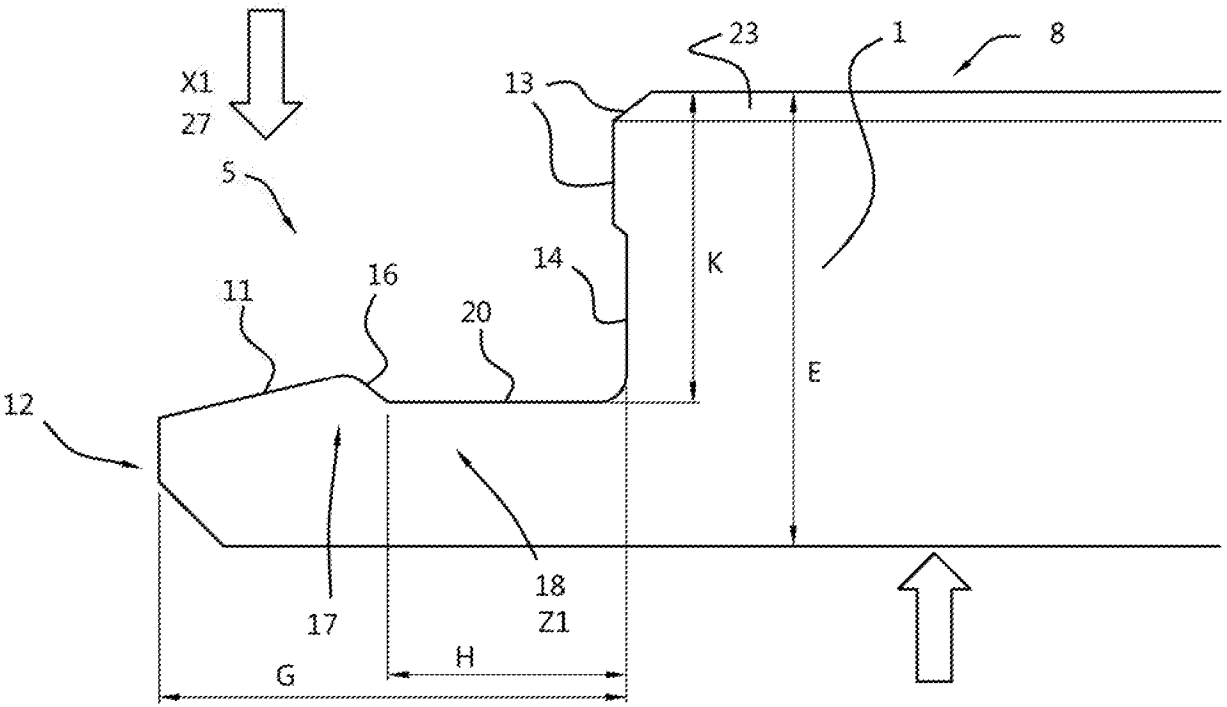
FIGS. 6A and 6B are cross-sectional views taken along the line 3-3 of FIG. 1 of other embodiments of the present invention.
Figure 6B:
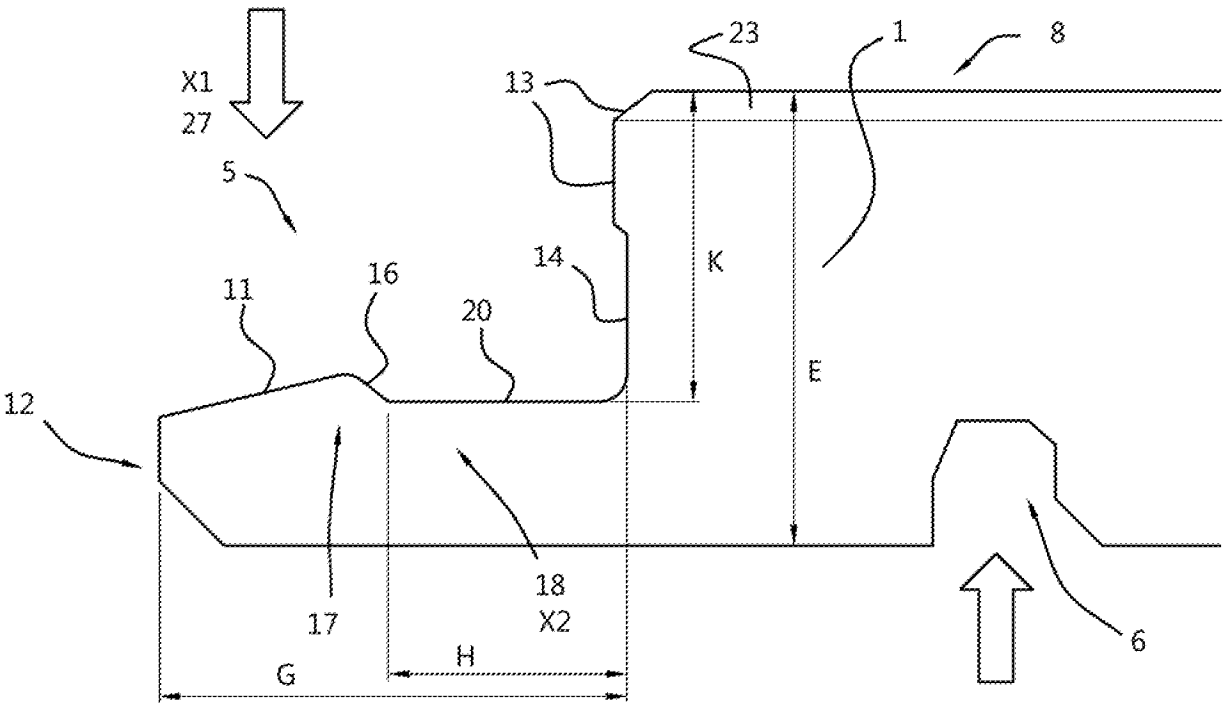

FIGS. 6A, 6B, 7, 8A and 8B are enlarged cross-sectional views of the edges of the board of further embodiments of the board as shown in FIGS. 1 and 2. All materials described above for the previous embodiment apply also to this embodiment. FIGS. 6A and 6B are a view of the section along line 3-3 of FIG. 1, and show a cross-section of a tongue 5. An intermediate section 18 of the tongue 5 extends towards the distal end of the hooking tongue 5. An upwardly extending projection 17 is disposed on the distal side of the tongue 5. The projection 17 has a bevelled nose 11 that faces generally outwardly and upwardly away from the board 8. The bevelled nose 11 slopes downwardly to the tip of the nose. The tongue 5 has a generally vertical tip surface 12 forming the side face of the bevelled nose 11. A further bevelled or rounded surface may be provided at the bottom of the surface 12 to form a tapered nose to the tongue 5. The projection 17 includes yet a further locking bevelled surface 16 which forms a generally inclined locking surface. Surface 16 faces upwardly and inwardly and slopes downwardly in a direction towards (more proximate to) the core layer 1 to a generally flat bearing surface 20 on top of the intermediate section 18. The upwardly facing surface 11 can meet the downwardly sloping surface 16 at an apex or a small flat (not shown). The flat bearing surface 20 may be horizontal (as shown) or inclined up or down e.g. plus or minus 5°. A surface 14 extends generally upwards from the flat bearing surface 20 towards the core layer 1 to join with the top of the main core layer 1. An equivalent surface is provided in the catch (surface 21 in FIG. 7). At the root of the tongue 5, a vertical surface 13 is provided which forms an upper abutment surface when two boards are joined together. This vertical surface 13 may be wholly in the core layer or may be wholly or partly in a decoration, tread or top surface layer 23. On the upper edge of the abutment a bevel 27 may be provided. This bevel 27 may be wholly in the core layer or may be wholly or partly in a decoration, tread or top surface layer 23.

The tongue 5 of this embodiment is preferably machined along the complete length of the edge of the board 8 as indicated by the arrow XI which indicates the movement of a suitable tool such as a milling tool that forms the upper surface shape of the tongue 5 by machining and which is described with reference to FIG. 15. A sequence of tools may be used whereby each tool only takes a partial amount of material away. The tongues are isolated from each other by the distance S shown in FIG. 1 by a machining process as described with respect to FIG. 12A to 12D, 13A to 13C, and 14A or 14C and indicated by the arrow YI or Y2 in FIG. 4.

Figure 7:
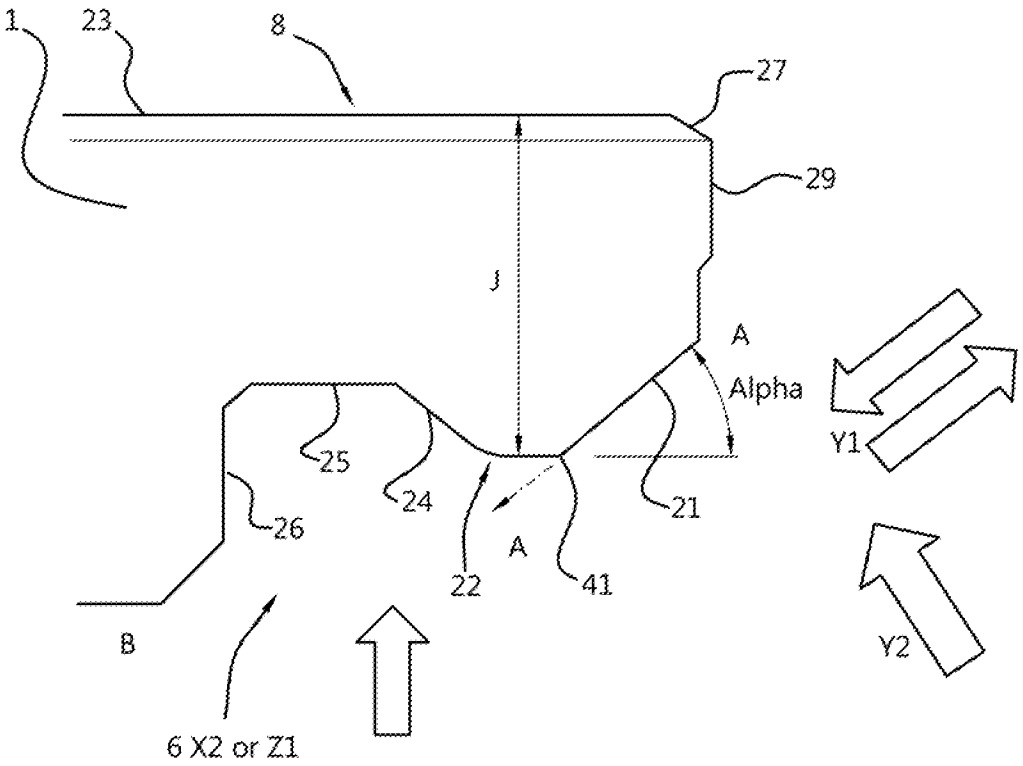
FIG. 7 is a cross-sectional view taken along the line 4-4 of FIG. 1 of the another embodiment of the present invention.
Figure 15:
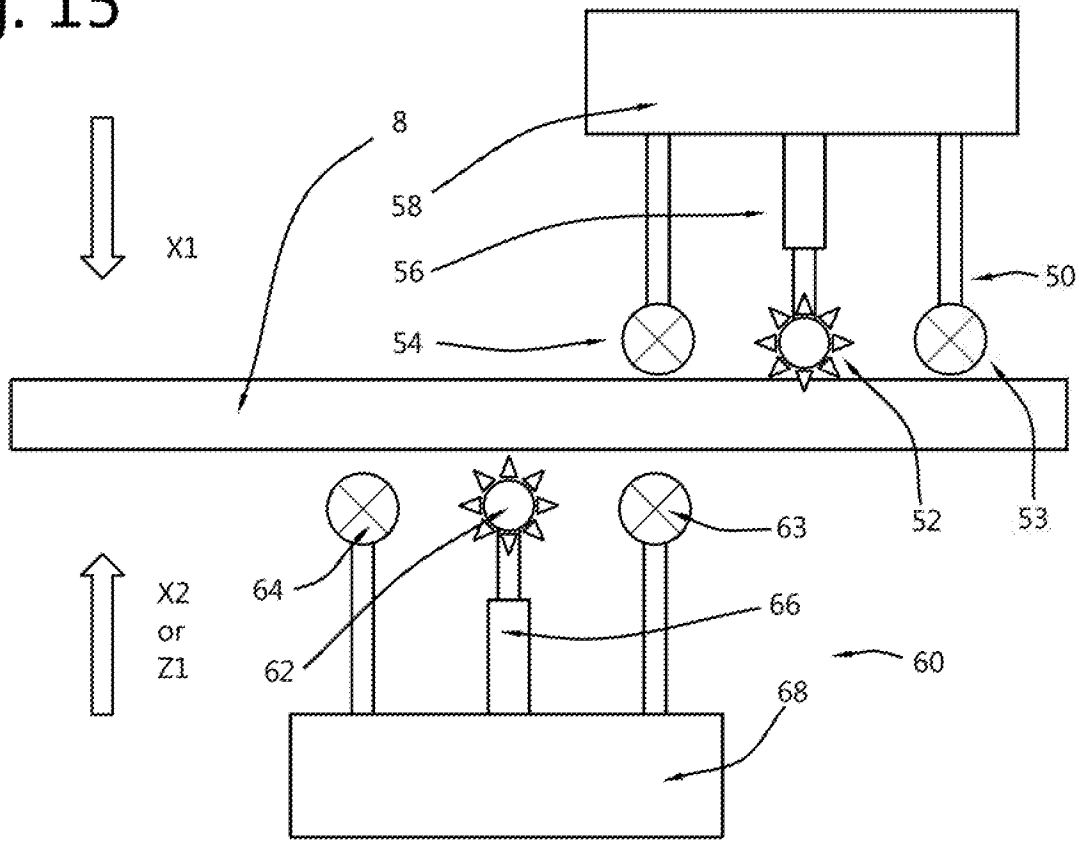
Figure 16:
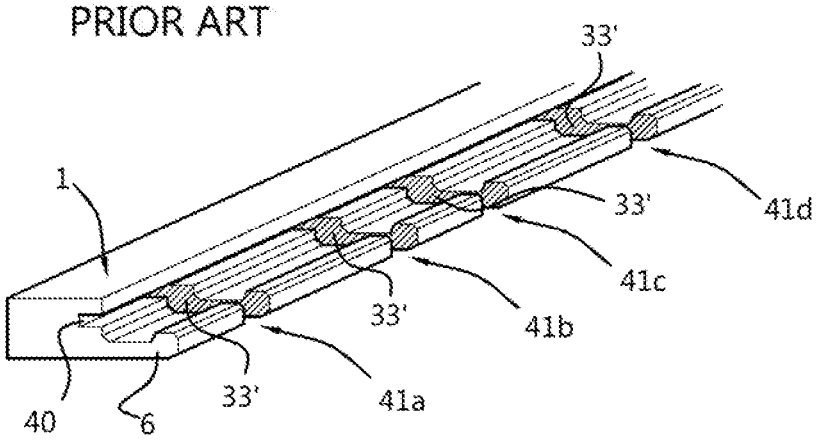
Fig. 16 PRIOR ART
FIGS. 16, 17 and 18 show prior art arrangements.
Figure 16:
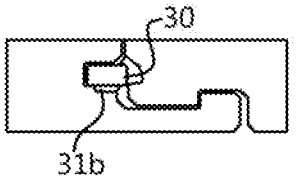
Fig. 16 PRIOR ART
Figure 17:
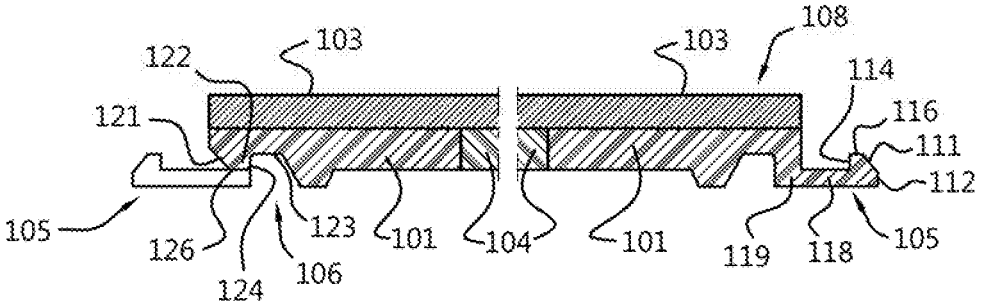
Fig. 17 Prior art
Figure 18:
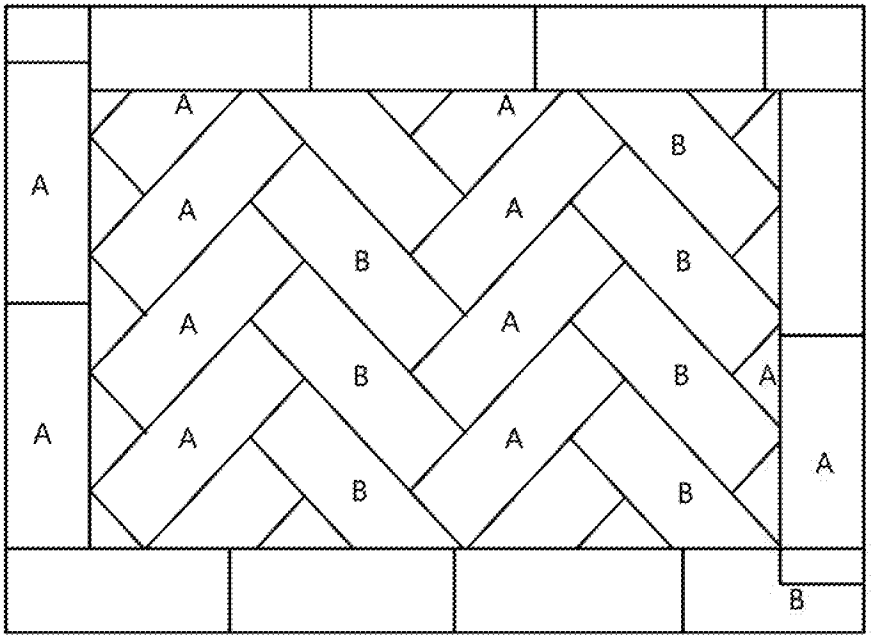
Fig. 18 Prior art

In the embodiment of FIG. 6A no recess in the form of a channel is disposed inwardly of the base 19 of the tongue 5. Instead the recesses 6 are discrete and are only located alongside or between tongues. Hence the recess 6 which is on the underside of the board (rather than on a side abutment surface), is shown in FIG. 7. The hooking tongue 5 of this embodiment can be made shorter than the tongues of the previous embodiment as the sheer strength is higher. Intermittent recesses 6 are machined long the length of the edge of the board 8 as indicated by the arrow ZI in FIG. 7 which indicates the movement of a suitable tool such as a milling tool that forms the recess 6 by being moved in and out in sequence with the movement of the board so that intermittent recesses are formed which lie between the positions of the tongues 5. The recess 6 may have various shapes, examples are shown in FIGS. 7 and 16. This machining is described with reference to FIGS. 13A, 13B and 15 with respect to process ZI.

Figure 13B:
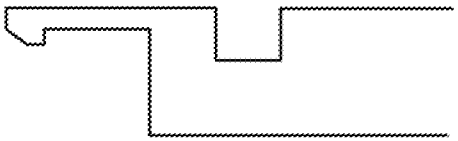
Figure 13A:
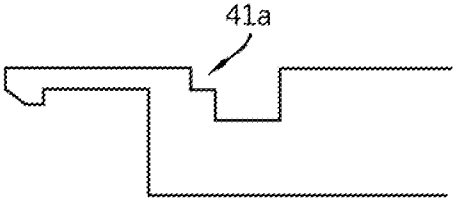

In the embodiment of FIG. 6B a recess 6 in the form of a channel is disposed inwardly of the base 19 of the tongue 5. The recess 6 is visible in FIG. 6B because the recess 6 is machined long the complete length of the edge of the board 8 as indicated by the arrow X2 which indicates the movement of a suitable tool such as a milling tool that forms the recess 6 by machining. The recess 6 may have various shapes, examples are shown in FIGS. 7 and 13A or 13B. The recess may be machined as described with respect to FIG. 15. FIG. 7 is a cross-section through the edge of a board 8 at a location between the tongues 5, i.e., at the location of a space 9 along line 4-4 in FIG. 1 and shows the recess 6. The shape of the edge face as shown in FIG. 7 is such that it will form a coplanar joint with a tongue of FIG. 6A/6B by sliding. FIG. 7 shows a locking edge 22 having a bevelled surface 21 that faces downwardly and outwardly from the core layer 1. The locking edge 22 has a further bevelled locking surface 24 which forms one boundary of the recess 6. The locking surface 24 is adapted to engage the locking surface 16 on the projection 17 of a tongue 5, when adjacent boards are joined. The locking edge 22 also has a horizontal surface 41 at its underside which joins the bevelled surfaces 21 and 24 together. The surface 41 nestles in the flat surface 20 of the tongue 5 when two boards are joined. The horizontal surface 41 is machined to allow the tongue 5 to pass underneath the core layer 1 and lock when two or more boards are joined by sliding tessellation. The horizontal surface 41 is machined so as to reduce the thickness of the board at this point to allow the tongue 5 to pass underneath the core layer 1 and lock when two or more boards are joined by sliding tessellation. Such a surface 41 can be generated by a longitudinal machining of a recess 6 (as described with reference to FIG. 15) having the shape as shown in FIG. 13A followed by a further machining step to isolate the tongues as described with reference to FIG. 13A to 13C, and 14A or 14C. The surface 41 is then generated when a step 41*a* is machined. The order of machining the recess and isolating the tongues can be reversed.

In particular when two boards are assembled it is preferred if there is a slight gap between the surfaces 14 and 21 of the order of 0.05 or 0.1 to 0.5 mm or more so that these surfaces do not meet before the surface 16 has locked behind the surface 24.

Above surface 21 a vertical surface 29 is provided which forms an upper abutment surface when two boards are joined together. This vertical surface 29 may be wholly in the core layer or may be wholly or partly in a decoration, tread or top surface layer 23. On the upper edge of the abutment a bevel 27 may be provided. This bevel 27 may be wholly in the core layer or may be wholly or partly in a decoration, tread or top surface layer 23.

Optionally the recess 6 has a top surface (or ceiling) 25 adapted to accommodate the nose of the projection 17 on the tip of a tongue during the locking process when adjacent boards are joined together. The top surface 25 may be flat (as shown) or curved and can be horizontal or inclined. The recess 6 may also have a generally vertical back wall 26. The bottom of the back wall 26 may also be bevelled or rounded.

Figure 8A:
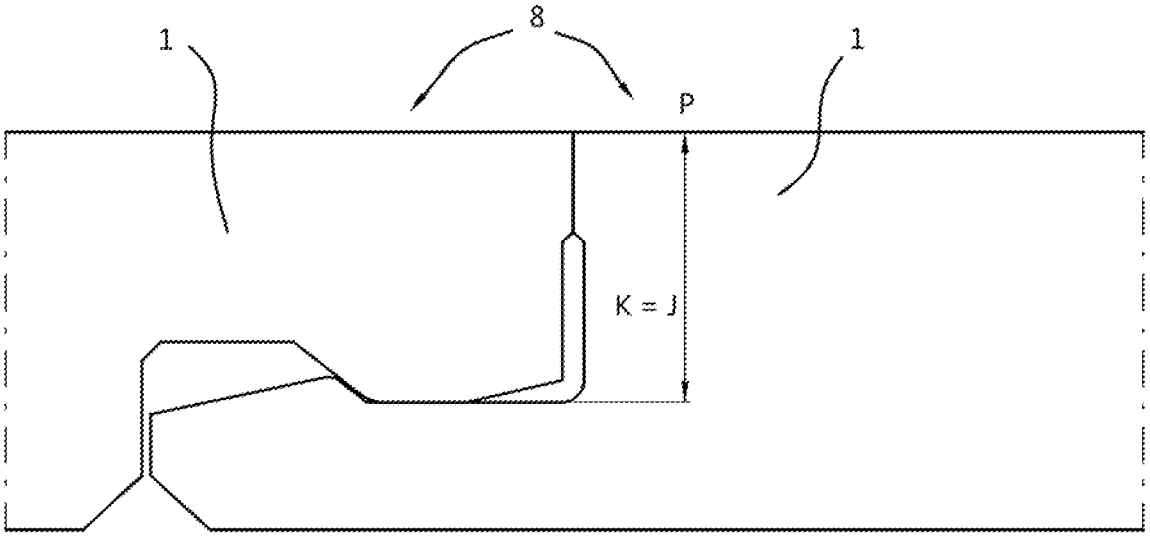
FIGS. 8A and 8B are cross-sectional views of two boards joined together according to other embodiments of the present invention.
Figure 8B:
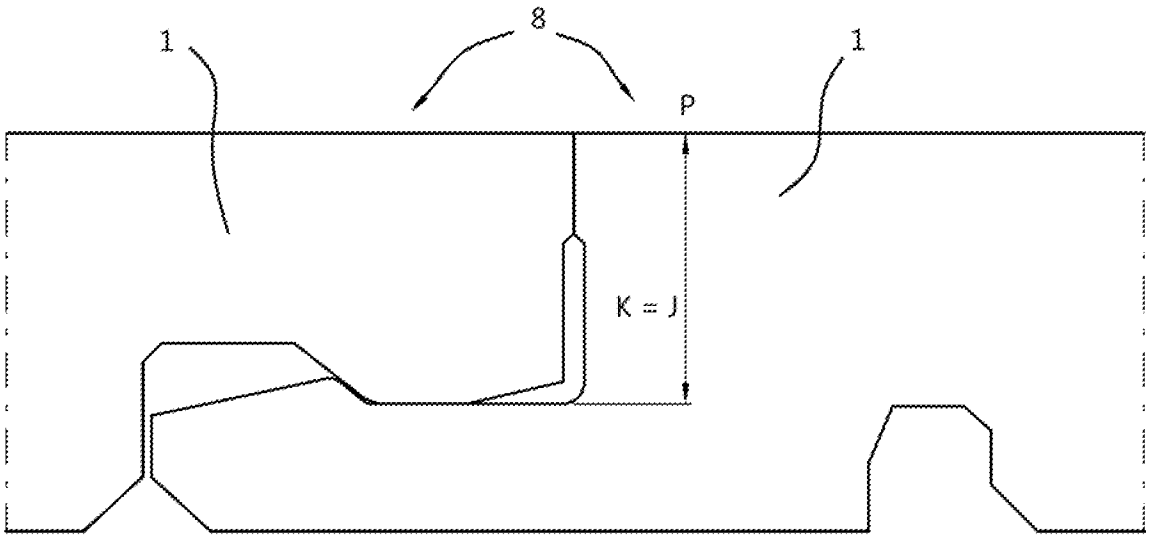

FIG. 8A is a cross-sectional view of two boards in accordance with FIGS. 6A and 7 in a joined configuration. FIG. 8B is a cross-sectional view of two boards in accordance with FIGS. 6B and 7 in a joined configuration. The boards described with reference to FIGS. 6A to 8B may include a decoration or surface layer 23. For example a luxury vinyl sheet with an embossed upper decorative layer can be affixed by an adhesive layer 28 (not shown) to the top surface of the core layer 1. The decorative or surface layer 23 may be chamfered or bevelled at the position of the join between two boards (the bevel edge has the reference number 27 in FIGS. 6A and 6B). The effect of the bevel 27 is to create a V-groove at the junction of two boards when they are installed.

With respect to any of the embodiments described with reference to FIGS. 3A to 5, 6B and 8B, a layer of resin can be applied to the underside of the tongue 5 and to fill up the recess 6 at the position of the tongue by a continuous process of applying resin such as fibre reinforced resin which can be sprayed onto the underside of core layer 1 in the appropriate pattern. A spray may be arranged to traverse back and forth over the core layer 1 as it is being machined and may apply a curing resin such as a glass fibre reinforced resin. By directing the spray head appropriately a layer can be applied generally to the surface of core layer 1 which will face towards the floor with the exception that the recesses 6 adjacent each tongue. These are left unfilled. The motion of the spray head can be arranged to fill the recesses 6 which are immediately inboard of the tongues 5 thus strengthening the tongues 5 without filling recesses 6.

Figures 9, 10, 11:
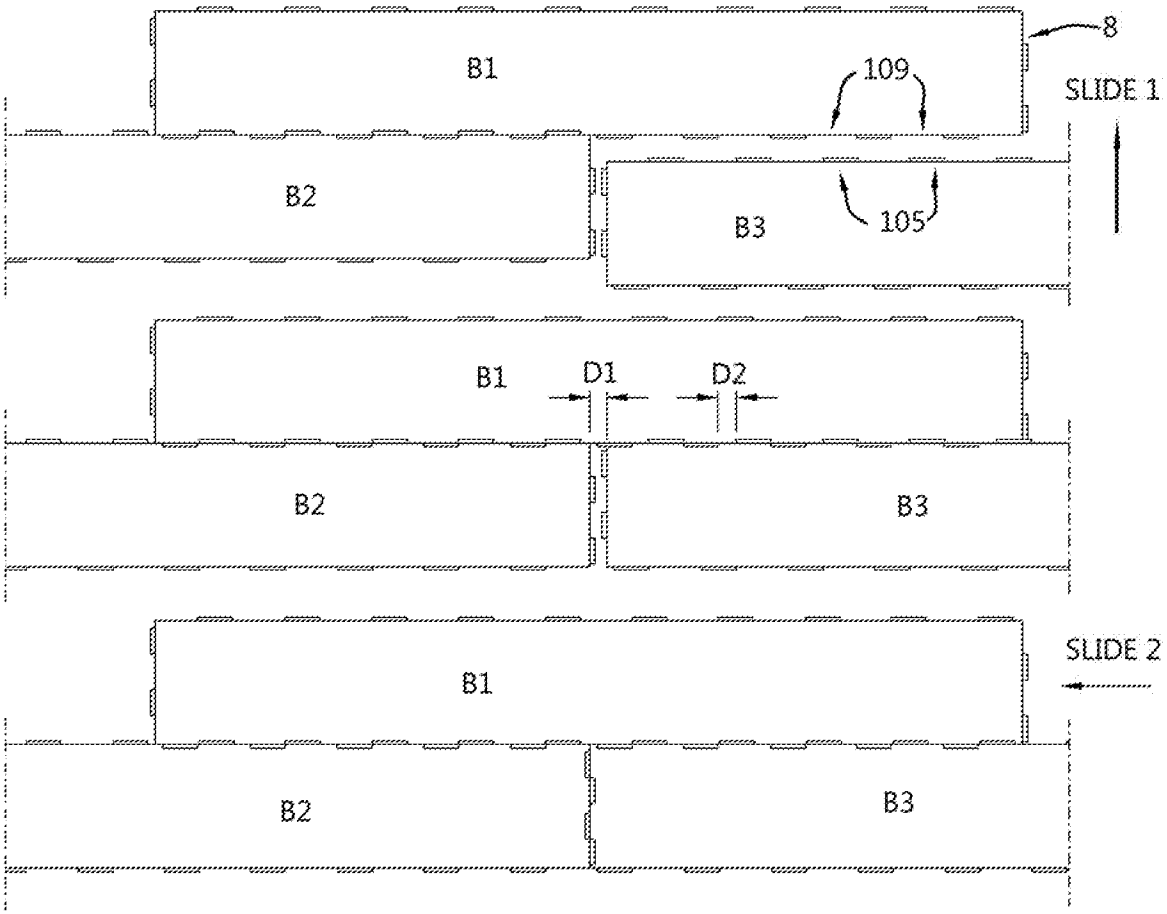
FIGS. 9, 10 and 11 show an assembly of boards in accordance with an embodiment of the present invention.

FIGS. 9, 10 and 11 show a series of positions of three boards, BI, B2 and B3 during an assembly of three boards. There are various ways the boards can be joined and this is just one example. Boards BI and B2 are first joined such that portions of their respective long edges are connected. This connection is preferably made by sliding board B2 along the floor toward board BI while the boards are co-planar (rather than by angling, i.e., by lifting the distal side of board B2) and inserting several of the tongues 105 along a portion of one long side of board BI into the spaces 109 between several tongues 105 along a portion of the proximal long side of board BI. A portion of the long side of board B3 may be joined to another portion of the same side of board BI in a similar manner, but should be done with the short sides of boards B2 and B3 near to each other as shown in FIG. 10, so that a small amount of displacement of board B3 toward board B2 will cause their short sides to engage one another in a locking manner (See FIG. 11). The locking engagement of short sides of boards B2 and B3 is made possible by two features: 1) the relationship of the size of the spaces 109 to the width of the tongues 105, which results in dimension D2 being at least as large as DI, and 2) the offset nature of the tongues 105 and spaces 109 on the opposing short sides of a board 8 (i.e., the right hand short side of board B2 and the left hand short side of board B3), as shown in FIGS. 9 through 11. Optionally the long sides of boards B2 and B3 may be angled into engagement with board BI.

In FIG. 9 the arrow SLIDE1 is intended to show the first direction of movement of board B3 in a two-step assembly of board B3 into a floor covering using boards 108. As noted above board B3 may be angled but is preferably slidingly latched into engagement with board BI. In FIG. 10, arrow SLIDE2 is intended to show the sliding and latching engagement of the left-hand short side of board B3 with the right-hand short side of board B2. Because the long side of board B3 was previously connected to the long side of board BI, board B3 cannot be lifted and angled into engagement with board B2, at least from the position shown in FIG. 10. It should be noted that, it is possible to form a floor covering with boards 108 by first connecting the short sides of boards B2 and B3 with a sliding or an angling technique, followed by a movement of board B3 toward board BI and slide-latching the long sides of boards B3 and BI into engagement.

Suitable production methods are known, for example machining and using tools to form the shapes described above for the hooking tongue and recesses in for example wood materials, wood-based boards and fibre-based materials, plastics or elastomers, or composite materials and that this type of machining can be made in a tongue or recess. As described above, embodiments of the present invention provide a combination of the design of the joint system with, for instance, specific angles, radii, play, free surfaces and ratios between the different parts of the system, and optimal utilization of the material properties of the core layer, such as compression, elongation, bending, tensile strength and compressive strength.

Machining of the edge surface which can be used in any of the embodiments of the present invention will now be described with reference to FIGS. 12A-12D, 13A-13C, 14A, 14C, and 15. FIG. 15 shows the machining of the upper surface of tongues 5 e.g. process XI as shown in previous figures, and the recess 6 on the underside of the board, e.g. process X2 or ZI as shown in previous figures. In the following the board 8 is assumed to be moving and the machining tools are assumed to be stationary. However in all embodiments the board may be kept stationary and tools moved. Also a plurality of tools may be used in sequence whereby each tool only removes a partial amount of material. Each tool in a sequence may have a different shape and may attack the edge of the board at a different angle and position.

To machine the upper surface of tongue 5 a machining station 50 is provided. Such a station 50 may include one or more machining tools 52 which may be rotating tools such as a milling tool. The machining tool 52 may be mounted on a cylinder or other position controlling device 56 which allows the exact position of the machining tool 52 particularly with respect to the top surface of the board 8. The machining tool 52 may be controlled and optionally powered from a controller 58 for instance to provide a low latency in control signals. To position the machining tool 52 accurately with respect to the upper surface of the board 8, optional guides 53 and 54 can be used which may be in the form of encoders, e.g. to provide a position and speed value for the movement of the board 8. The guides 53 and 54 may not only determine the depth of penetration of the machining tool 52 but may also guide the machining tool 62 to take up a defined position with respect to the edge of the board 8. The speed of the board affects the rate of cutting of the machining tool 52 which is best kept within optimum limits. For this purpose the controller 58 may receive the outputs of position and speed encoders 53 and/or 54 and feed these results to a controller (not shown) of the speed of the board. The machining tool 52 may include one or more actual tools—sufficient to carry out the process XI described with reference to the previous figures and embodiments.

To machine the recess 6 on the underside of board 8 a machining station 60 is provided. Such a station 60 may include one or more machining tools 62 which may be a rotating tool such as a milling tool. The tool such as a milling tool may be mounted on a movable cylinder or other position controlling device 66 which allows the exact positioning of the machining tool 62 with respect to the bottom surface of the board 8, e.g. by means of hydraulic pressure. The machining tool 62 may be controlled and optionally powered from a controller 68 again to reduce latency. To position the machining tool 62 accurately with respect to the lower surface of the board 8, optional guides 63 and 64 can be used which may be in the form of encoders, e.g. rotational encoders to provide a position and speed value for the movement of the board 8. The guides 63 and 64 may not only determine the depth of penetration of the machining tool 62 but may also guide the machining tool 62 to take up a defined position with respect to the edge of the board 8. The speed of the board affects the rate of cutting of the machining tool 62 which is best kept within optimum limits. For this purpose the controller 68 may receive the outputs of position and speed encoders 63 and/or 64 and feed these results to a controller (not shown) of the speed of the board. The machining tool 62 may include one or more actual tools—sufficient to carry out the process X2 described with reference to the previous figures and embodiments.

In case an intermittent recess 6 is to be produced, e.g. by the process ZI as described above, the position controlling device 66 moves the machining tool 62 up and down to engage the bottom edge surface of the board at the times as synchronised with reference to the movement of board 8 as captured by the position and speed encoders 63 and/or 64. The movement of the machining tool in and out determines the position of the recesses 6 which has to be coordinated with the position of the tongues 5.

The distance of the recess 6 from the edge of the board 8 and the length of the tongue 5 need to be closely controlled.

Figure 12A:
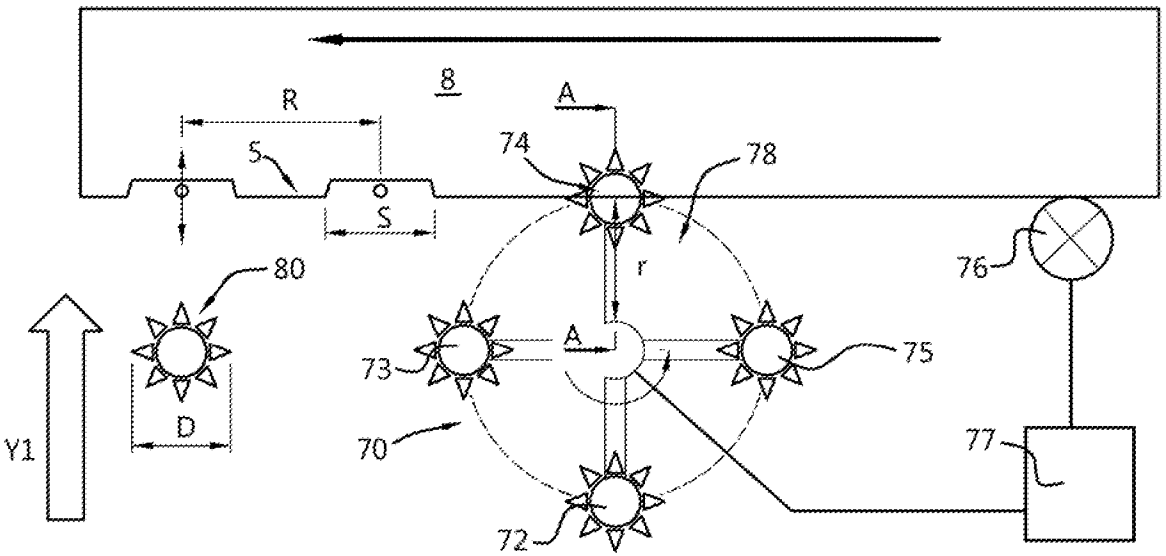
FIGS. 12A-12D, 13A-13C, 14A-14D and 15 show methods of machining which are embodiments of the present invention.
Figure 12B:
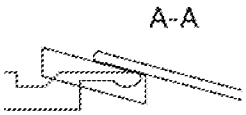
Figure 12C:
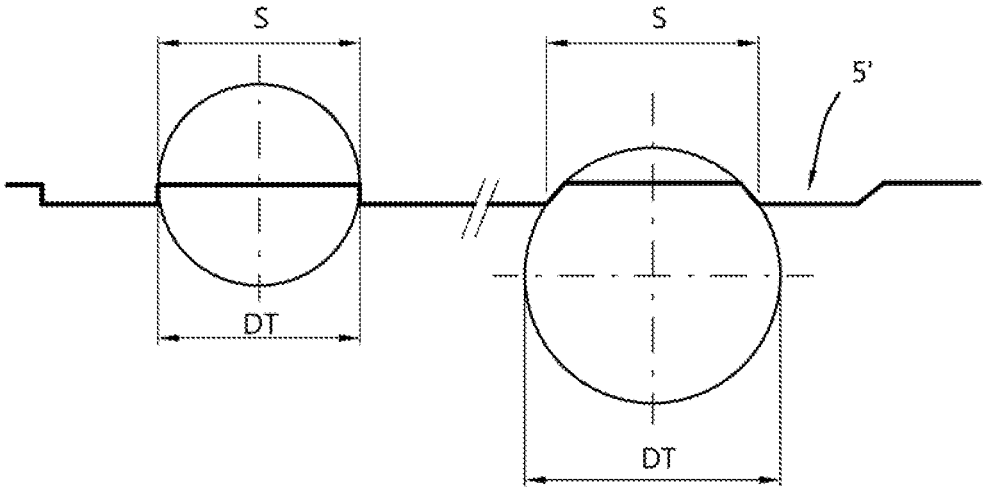

To isolate the tongues in accordance with process YI as previously described, a machining station 70 is provided as shown in FIG. 12A. In the drawings the machining station moves into the board from outside an edge thereof. However, the movement can also be in the opposite direction, i.e. from within the board going out. The station 70 may include a plurality of machining tools 72-75 on a head or turret 78. Four tools are shown but a practical number may be 8 to 10 or more. Each machining tool can be a rotating tool such as a milling tool. The tools rotate about an axis that is tilted to the vertical by an angle alpha. The machining tools may be mounted on an indexing head or rotating head 78. The head 78 is controlled by a controller 77 which receives a position and/or velocity output from an encoder 76. Encoder 76 measures the movement of board 8 and may be any suitable encoder, such as optical, mechanical, magnetic etc. The encoder 76, controller 77 in combination with the drive of the head 78 allows the exact positioning of the machining tool 72-75 which is to engage with the side surface of board 8 with respect to the longitudinal movement of board 8. Where the recesses are intermittent and are already formed in the underside, encoder 76 may be adapted to pick up the start of each recess and to co-ordinate the position of the relevant machining tool 72-75 so that the recesses 6 are adjacent to each tongue 5. To position the head 78, the head may be mounted on a carriage which can position the head accurately with respect to the edge of the board to be machined. The speed of the board affects the rate of cutting of the machining tools 72-75 which is best kept within optimum limits.

Each tool makes a reciprocating motion towards and away from the board in a direction perpendicular to the movement of the board as the head 78 rotates while at the same time traversing a translation motion parallel to the motion of the board. As at least one tool has an axis of rotation tilted at an angle alpha to the vertical the machining of the board in the gaps between the tongues forms a sloping section of the abutment surface of joining boards which is the surface 21 at the angle alpha to the horizontal.

It is preferred if the full width of each tool 72-75 penetrates into the board. In that case the width S of the spaces between the tongues equals or almost equals the diameter DT of each tool (see left hand image in FIG. 12C). A larger diameter of tool can be used (see right hand image in FIG. 12C) but then the tool does not penetrate so far into the board and the side edges of the tongue are not straight but curved resulting in a tongue 5' with a trapezoidal shape.

Figure 12D:
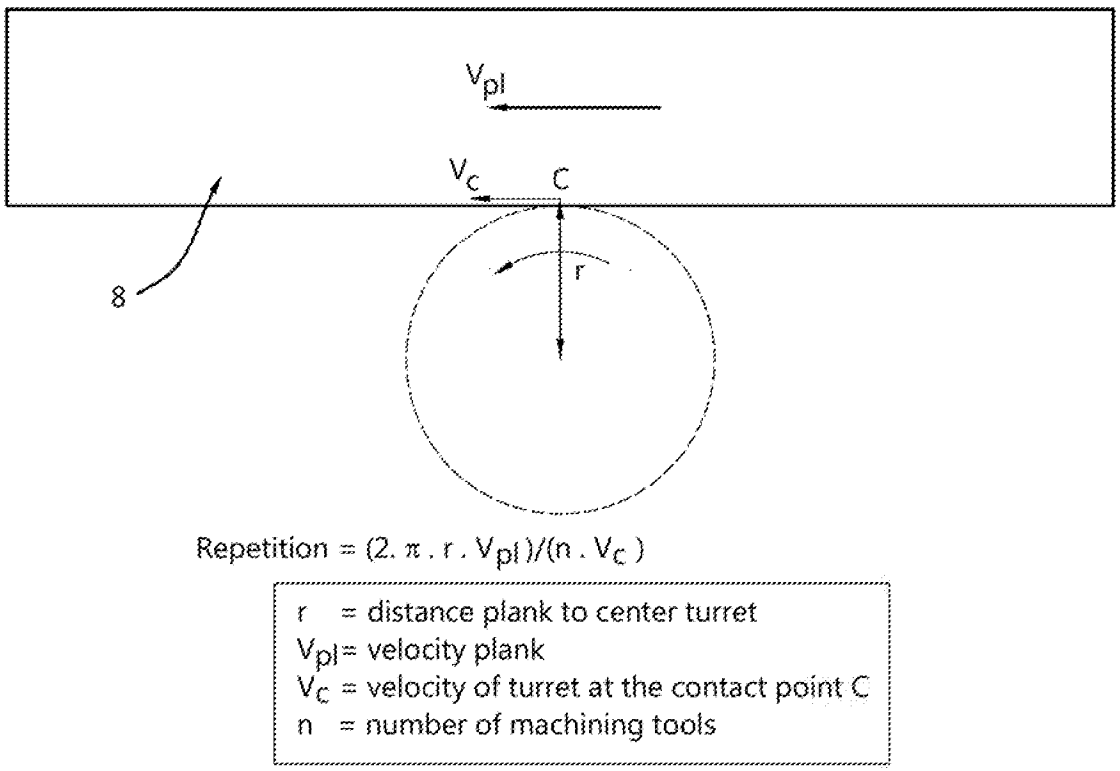

The repetition distance R is given by (see FIG. 12D)

$$R=(2\cdot\pi\cdot r\cdot V_{pi})/(n\cdot V_C)$$

Where r=distance edge of board to center turret $V_{pi}$=velocity of the board $V_C$=velocity (in the same direction as movement of the board) of tool on the turret at the contact point with the board n=number of machining tools.

Figure 13C:
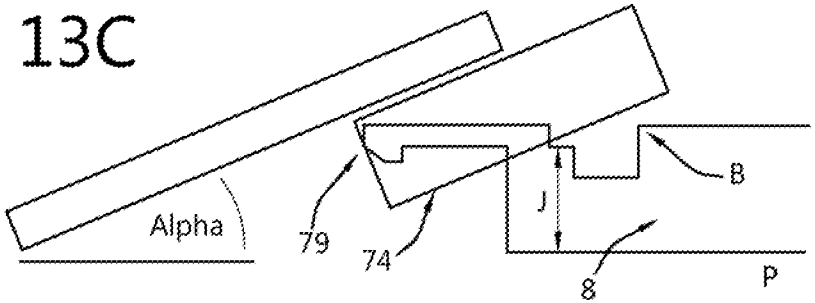

FIG. 13C is a schematic drawing showing one of the heads 72 to 75 engaging with an edge of a board 8 in which the bottom surface of the board already has a continuous recess 6. The board is shown inverted with the bottom side upwards. The machining tool 74 is shown entering the edge of board 8 at an angle alpha. The cutting surface 79 removes the tongue 5 at this position as the board 8 and tool 74 move together with the rotation of the indexing or rotating head 78 which is driven to follow the movement of board 8. The angle alpha is chosen so as to form the sloping surface 21 in FIGS. 4 and 7. If a surface 41 is to be formed as shown in FIGS. 4 and 7, the recess 6 as shown in FIGS. 3A, 3B, or FIG. 13A can be used. This recess can have a step 41*a* which forms the surface 41 after other parts have been removed by machining tool 74. Angle alpha is preferably chosen so that the cutting surface 79 does not remove any or too much material from corner "B" of the recess 6. The sequence of machining can be reversed such that the tongues are isolated first and the recess 6 or part of it is machined second.

Individual boards may also be machined using a head 80. This can be used for the shorter sides of oblong floor tiles for instance. Tool 80 may be moved in and out as described above while the board is held stationary.

Alternative method of machining can be used such as an Archimedes screw or a CNC machine. Cutting using an Archimedes screw takes advantage that the outer surface of the screw moves forward as the screw rotates. If cutting edges are provided on the outer surface then it can be arranged that the cutting surface acting on the board moves forwards at the same speed as the board as the surface rotates and carries out a cutting action.

In conventional CNC machining the board is held stationary and cutting tools are moved. The CNC machine can be combined with movements of an X-Y table. Dedicated moving tables can also be used as shown schematically in FIG. 14A or 14C.

Figure 14A:
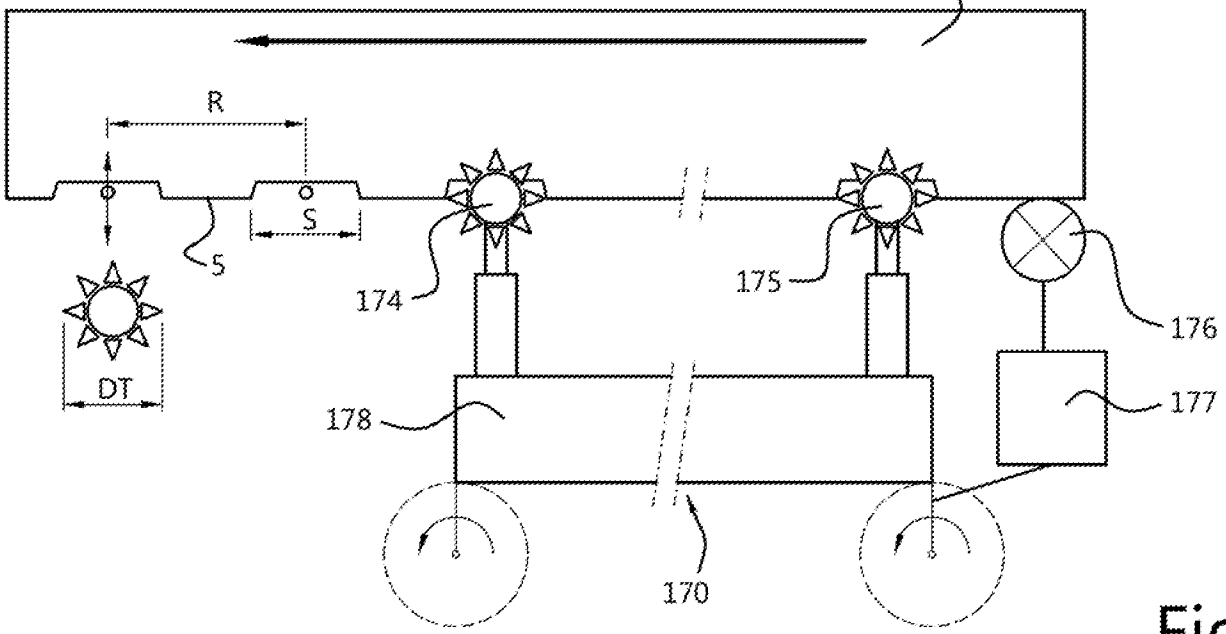
Figure 14B:
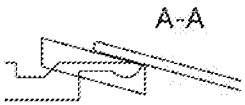

To isolate the tongues in accordance with process YI as previously described, a machining station 170 can also be provided as shown in FIG. 14A. The machining station 170 moves into the board to machine. The station 70 may include a plurality of machining tools 174, 175 on a table 178. Two tools are shown but the present invention is not limited thereto. Each machining tool 174, 175 can be a rotating tool such as a milling tool. The tools rotate about an axis that is tilted at an angle alpha to the vertical. The table 178 is controlled by a controller 177 which receives a position and/or velocity output from an encoder 176. Encoder 176 measures the movement of board 8 and may be any suitable encoder, such as optical, mechanical, magnetic etc. The encoder 176, controller 177 in combination with the drive of the head 178 allows the exact positioning of the machining tool 174, 175 which is to engage with the side surface of board 8 with respect to the longitudinal movement of board 8. Where the recesses are intermittent and are already formed in the underside, encoder 176 may be adapted to pick up the start of each recess and to co-ordinate the position of the relevant machining tool 174, 175 so that the recesses 6 are adjacent to each tongue 5. To position the table 178, the table is driven by a suitable drive which moves the tools 174, 175 towards the board and also sideways in a combined reciprocating and translational motion. The forwards and sideways speed of the tools 174, 175 are controlled to isolate the tongues by machining while producing the edge shape for the sections between the tongues so that tongues lock into the recesses on joining.

Each tool makes a reciprocating motion towards and away from the board as the head 178 moves towards and away from the board perpendicular to the motion of the board while at the same time traversing a translation motion parallel to the motion of the board. As at least one tool has an axis of rotation tilted at an angle alpha to the vertical the machining of the board in the gaps between the tongues forms a sloping section of the abutment surface of joining boards which is the surface 21 at the angle alpha to the horizontal.

As previously it is preferred if the full width of each tool 174, 175 penetrates into the board. In that case the width S of the spaces between the tongues equals the diameter DT of each tool. A larger diameter of tool can be used but then the tool does not penetrate so far into the board and the side edges of the tongue are not straight but curved resulting in a tongue with a trapezoidal shape.

Figure 14C:
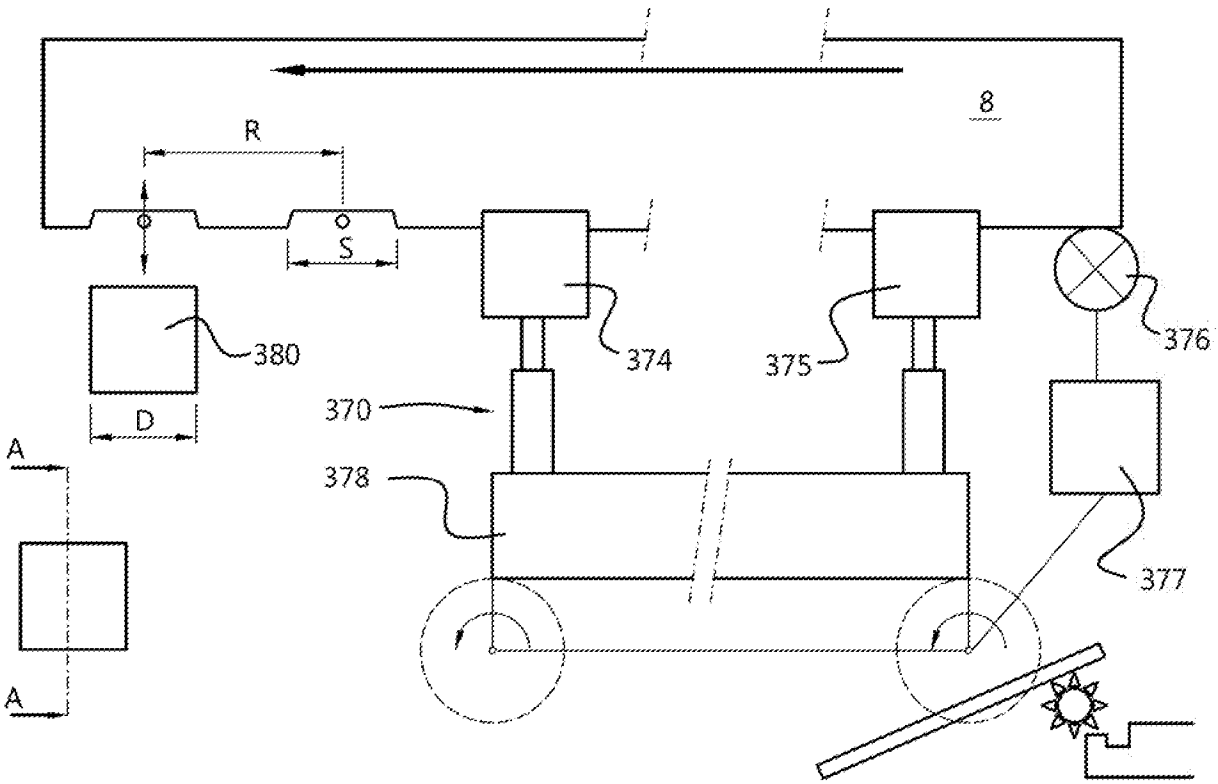
Figure 14D:
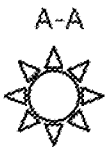

To isolate the tongues in accordance with process Y2 as previously described, a machining station 370 is provided as shown in FIG. 14C. The machining station 370 moves towards the board to machine and moves away again. The station 170 may include a plurality of machining tools 374, 375 on a table 378. Two tools are shown but the present invention is not limited thereto. Each machining tool 374, 375 can be a rotating tool such as a milling tool. The rotational axis of these tools is horizontal. The shape of the board between the tongues created by machining with these tools results in the surface 21 being slightly curved having a radius the same as the radius of the tools, whereby the machined surface 21 is concave. The table 378 is controlled by a controller 377 which receives a position and/or velocity output from an encoder 376. Encoder 376 measures the movement of board 8 and may be any suitable encoder, such as optical, mechanical, magnetic etc. The encoder 376, controller 377 in combination with the drive of the head 378 allows the exact positioning of the machining tool 374, 375 which is to engage with the side surface of board 8 with respect to the longitudinal movement of board 8. Where the recesses are intermittent and are already formed in the underside, encoder 376 may be adapted to pick up the start of each recess and to co-ordinate the position of the relevant machining tool 374, 375 so that the recesses 6 are adjacent to each tongue 5. To position the table 378, the table is driven by a suitable drive which moves the tools 374, 375 towards the board and also sideways in a combined reciprocating and translational motion. The forwards and sideways speed of the tools 374, 375 are controlled to isolate the tongues by machining while producing the edge shape for the sections between the tongues so that tongues lock into the recesses on joining.

Each tool makes a reciprocating motion towards and away from the board in a direction perpendicular to the movement of the board as the table 378 moves back and forth while at the same time traversing a translation motion parallel to the motion of the board 8. At least one tool has a horizontal axis of rotation the machining of the board in the gaps between the tongues and forms a concave sloping section of the abutment surface of joining boards which is the surface 21.

Individual boards may also be machined using a head 380. This can be used for the shorter sides of oblong floor tiles for instance. Tool 380 may be moved in and out as described above while the board 8 is held stationary.

The shape of a tongue produced with the arrangement shown in FIG. 14C can be altered by altering the profile of the cutting tools. If the cutting tool has sloping or beveled edges then the tongue produced will be trapezoidal in shape as shown in FIG. 14C. If the sloping or beveled edge is curved then a semi-circular tongue or a rectangular or square tongue with radiused corners is produced. The tools shown in FIG. 14A or 14C or 15 can be combined with other machining operations e.g. laser cutting which can then provide other shapes of tongue as determined by the trajectory of the laser beam. For example the basic shape of the tongues may be formed by milling followed by a trimming step using a laser.

Embodiments of the present invention can be provided at a lower production cost while at the same time function and strength can be retained or even, in some cases, be improved by a combination of manufacturing technique, joint design, and choice of materials.

What is claimed is:

1. A polygonal board being three-, four-, five-, or six-sided and having a core layer with an underside, a topside, edges and edge faces, the core layer having a plurality of latching tongues formed integrally with the core layer and extending outwardly from the edges of the core layer, the core layer having recesses, each recess being for engaging with a latching tongue of the plurality of latching tongues of another board, at least one of the latching tongues and at least one of the recesses being arranged to allow sliding mating of the at least one latching tongue of a first board with the at least one recess of a second adjacent board thereby forming an abutment surface in a joint between the first board and the second board, the at least one latching tongue and the at least one recess of adjacent boards co-operating to provide both vertical and horizontal locking engagement of the two boards, wherein the at least one recess is arranged between two of the latching tongues or adjacent a latching tongue of the plurality of the latching tongues, further comprising beveled surfaces formed on outer edges of the core layer in areas between the latching tongues or adjacent the latching tongues, and the latching tongues having beveled nose surfaces, such that joining of the board to another said board can be done by sliding the boards together while they are substantially co-planar, whereby a beveled surface on the edges of the core layer of the board is adapted to contact the beveled nose surface of a latching tongue of another similar board and facilitates the latching tongue passing along and under the beveled surface of the edge into one of the recesses on the underside of the core layer.

2. The board of claim 1, wherein the abutment surface has a sloping section that extends over a distance of at least 10% of a thickness of the board, or wherein the abutment surface has a sloping section that extends over a horizontal distance of at least 10% of a length of one of the latching tongues, or wherein the sloping section is at an angle of 10 to 60° with respect to the core layer.

3. The board of claim 1, wherein the recesses are discrete recesses formed in the underside of the core layer of each edge of the board, but not at a latching tongue position.

4. The board of claim 1, further comprising the latching tongues along one side of the core layer that are located at positions that are staggered with respect to locations of the latching tongues on an opposite or opposing side of the core layer;

each latching tongue on the core layer has a width, and each of the latching tongues are separated from an adjacent latching tongue by a space (S), the space (S) between the latching tongues on the core layer being at least as wide as the widest of the latching tongues on the core layer, such that any side of the board may be connected to any side of another board of a substantially similar configuration.

5. The board of claim 4 wherein the beveled surfaces formed the outer edges of the core layer in areas between the latching tongues or adjacent the latching tongues correspond to the spaces.

6. The board of claim 1, wherein each of the latching tongues has an upward protrusion on a distal side of the latching tongue, one side of the protrusion forming at least a portion of the beveled nose surface, another generally inwardly facing side of the protrusion defining a locking surface for engagement with a generally inwardly facing locking surface of one of the recesses of an adjacent board, each of the latching tongues having an intermediate section having a generally flat upwardly facing surface extending outwardly of the edge of the board, the upwardly facing surface of the intermediate section adapted to receive and abut a downwardly extending locking edge disposed inward of the edge of an adjacent board between the latching tongues of the adjacent board.

7. The board of claim 6, wherein the locking edge forms part of one of the recesses in the form of a discontinuous groove formed in the underside of the board, the groove running alongside and parallel to at least a part of each of the edges of the board.

8. The board of claim 6, wherein a bottom surface of the locking edge is flat.

9. The board of claim 1, wherein the core layer is selected from a plastic material, and a plastic material that is foamed.

10. The board of claim 1, wherein a color is printed on the topside of the board.

11. The board of claim 1, wherein the core layer comprises a single piece of plastic material or foamed plastic material.

12. A method of manufacture of a three-, four-, five, or six-sided board having a core layer with an underside, edges and edge faces, the method comprising:

forming a plurality of recesses in the core layer, forming an upper shape of a plurality of latching tongues extending outwardly from the edges of the core layer; and whereby the recesses are adapted for engaging with the latching tongues, at least one latching tongue of the plurality of latching tongues and the plurality of recesses of each board being arranged to allow engagement of the at least one latching tongue of a first board with the recesses of a second adjacent board to form a tessellation, further machining so that the at least one recess is arranged between two of the latching tongues or adjacent a latching tongue, or the plurality of the latching tongues, further comprising beveled surfaces formed on outer edges of the core layer in areas between the latching tongues or adjacent the latching tongues, and the latching tongues having beveled nose surfaces, such that joining of the board to another said board can be done by sliding the boards together while they are substantially co-planar, whereby a beveled surface on the edges of the core layer of the board is adapted to contact the beveled nose surface of a latching tongue of another similar board and facilitates the lathing tongue passing along and under the beveled surface of the edge into one of the recesses on the underside of the core layer.

13. The method of claim 12, wherein an abutment surface on each latching tongue is formed by machining, the abutment surface having a sloping section that extends over a distance of at least 10% of the thickness of the board, or wherein the abutment surface on each latching tongue has a sloping section that extends over a horizontal distance of at least 10% of the length of a latching tongue, or wherein the abutment surface on each latching tongue has a sloping section that is at an angle of 10 to 60° with respect to the core layer.

14. The method of claim 12, wherein latching tongues are isolated from each other by sequential application of a plurality of machining tools on a rotating head, or wherein the latching tongues are isolated from each other by sequential application of a plurality of machining tools on an indexing head, or wherein the latching tongues are isolating from each other by sequential application of a plurality of machining tools on an oscillating table.

15. The method of claim 14, wherein movement of the machining tools is synchronized with a forward motion of the board, or wherein the machining forming the recesses or discrete recesses is synchronized with the forward motion of the board.

16. The method of claim 12, further comprising isolating of the latching tongues from each other by machining with at least one rotating tool, the rotating tool making a reciprocating motion towards and away from the board in a direction perpendicular to a movement of the board while at the same time having a translational motion parallel to a motion of the board.

17. The method of claim 16, wherein the at least one tool has an axis of rotation tilted at an angle alpha to a vertical axis, the machining of the board in the gap between the latching tongues forming a sloping section of the abutment surface of joining boards at the angle alpha to a horizontal axis.

18. The method of claim 16, wherein the at least one tool has a horizontal axis of rotation, the machining of the board in gaps between the latching tongues forming a sloping section of the abutment surface of joining boards that is concave.

19. The method of claim 12, wherein a repetition distance R of the latching tongues, which are staggered, is given by $$R=(2\cdot n\cdot r\cdot Vpi)/(n\cdot Ve),$$

where r=distance edge of board to centre of a machining turret, Vpi=velocity of the board, Ve=velocity (in a same direction as movement of the board) of tool on the turret at the contact point with the board, and n=number of machining tools.

20. The method of claim 16, wherein the machining of the latching tongues forms in each of the latching tongues an upward protrusion on a distal side of the latching tongue, one side of the protrusion forming at least a portion of the beveled nose surface, another generally inwardly facing side of the protrusion defining a locking surface for engagement with a generally inwardly facing locking surface of the recess of an adjacent board, each of the latching tongues having an intermediate section having a generally flat upwardly facing surface extending outwardly of the edge of the board, the upwardly facing surface of the intermediate section adapted to receive and abut a downwardly extending locking edge disposed inward of the edge of an adjacent board between the latching tongues of the adjacent board.

21. The method of claim 20, wherein the machining for isolating the latching tongues forms the locking edge from a part of the recess in the form of a discontinuous groove formed in the underside of the board, the groove running alongside and parallel to at least a part of each of the edges of the board.

22. The method of claim 21, wherein the part of a recess is a step with a flat surface and the machining to isolate the latching tongues forms a bottom surface of the locking edge from the flat surface of the step.

23. The method of claim 16, wherein the machining is by any of or any combination of milling, grinding, laser cutting, laser ablation, sawing, CNC machining, by cutting with an Archimedes screw, with the board being held stationary.

24. The method of claim 12, wherein the board is kept stationary during at least one of the following steps:

when forming a plurality of recesses or discrete recesses in the underside of the core layer, when forming an upper shape of latching tongues extending outwardly from the edges of the core layer, when isolating the latching tongues from each other.

* * * * *